US009623697B2

(12) United States Patent
Ishida et al.

(10) Patent No.: US 9,623,697 B2
(45) Date of Patent: Apr. 18, 2017

(54) THERMAL TRANSFER SHEET

(71) Applicant: DAI NIPPON PRINTING CO., LTD., Tokyo-to (JP)

(72) Inventors: Tadahiro Ishida, Tokyo-to (JP); Masato Takao, Tokyo-to (JP)

(73) Assignee: DAI NIPPON PRINTING CO., LTD., Tokyo-to (JP)

( * ) Notice: Subject to any disclaimer, the term of this patent is extended or adjusted under 35 U.S.C. 154(b) by 0 days.

(21) Appl. No.: 14/764,328

(22) PCT Filed: Sep. 12, 2014

(86) PCT No.: PCT/JP2014/074294
§ 371 (c)(1),
(2) Date: Jul. 29, 2015

(87) PCT Pub. No.: WO2015/045923
PCT Pub. Date: Apr. 2, 2015

(65) Prior Publication Data

US 2015/0360497 A1 Dec. 17, 2015

(30) Foreign Application Priority Data

Sep. 26, 2013 (JP) ..... 2013-200486
Sep. 30, 2013 (JP) ..... 2013-203692
(Continued)

(51) Int. Cl.
*B41M 5/382* (2006.01)
*B41M 5/44* (2006.01)
(Continued)

(52) U.S. Cl.
CPC ..... *B41M 5/423* (2013.01); *B41M 5/38207* (2013.01); *B41M 5/395* (2013.01);
(Continued)

(58) Field of Classification Search
CPC .... B41M 5/38207; B41M 5/395; B41M 5/42; B41M 5/44; B41M 2205/06; B41M 2205/30; B41M 2205/36; B41M 2205/38
(Continued)

(56) References Cited

U.S. PATENT DOCUMENTS 5,795,656 A 8/1998 Hirose

FOREIGN PATENT DOCUMENTS

JP 57105395 A 6/1982
JP 0494983 A 3/1992
(Continued)

OTHER PUBLICATIONS

International Search Report mailed Dec. 16, 2014; PCT/JP2014/074294.

*Primary Examiner* — Bruce H Hess
(74) *Attorney, Agent, or Firm* — Ladas & Parry LLP

(57) ABSTRACT

Provided is a thermal transfer sheet which has satisfactory printability and provides a printed matter having excellent boiling resistance.
Disclosed is a thermal transfer sheet which is provided with a substrate, at least a transferable protective layer and a transferable color layer in this order on one side of the substrate, and is provided with a back face layer on the other side of the substrate, characterized in that the transferable protective layer contains a cyclic olefin-based polymer having a glass transition temperature of 100° C. or more as a main component and further contains an incompatible resin with the cyclic olefin-based polymer, and the transferable color layer contains a colorant and a phenolic resin having a softening point of 100° C. or more.

12 Claims, 2 Drawing Sheets

(30) Foreign Application Priority Data

Jan. 8, 2014 (JP) ..... 2014-001894
Mar. 17, 2014 (JP) ..... 2014-053391

(51) Int. Cl.
*B41M 5/42* (2006.01)
*B41M 5/395* (2006.01)

(52) U.S. Cl.
CPC ..... *B41M 5/426* (2013.01); *B41M 5/44* (2013.01); *B41M 2205/06* (2013.01); *B41M 2205/30* (2013.01); *B41M 2205/36* (2013.01); *B41M 2205/38* (2013.01); *B41M 2205/40* (2013.01)

(58) Field of Classification Search
USPC ..... 428/32.77
See application file for complete search history.

(56) References Cited

FOREIGN PATENT DOCUMENTS

| | | | |
|---|---|---|---|
| JP | 0958140 | A | 3/1997 |
| JP | 2002-192839 | A | 7/2002 |
| JP | 2004-230682 | A | 8/2004 |
| JP | 2006-306019 | A | 11/2006 |
| JP | 2011-201212 | A | 10/2011 |

THERMAL TRANSFER SHEET

TECHNICAL FIELD

The present invention relates to a thermal transfer sheet for a thermofusible transfer system.

BACKGROUND ART

A thermofusible transfer system is conventionally known, by which energy corresponding to image information is applied to a heating device such as a thermal head, using a thermal transfer sheet in which a thermofusible ink layer having a colorant such as a pigment dispersed in a binder such as a thermofusible wax or resin is supported on a substrate sheet such as a plastic film, and the colorant is transferred together with the binder onto a transfer-receiving paper such as paper or a plastic sheet (Patent Literature 1). An image formed by the thermofusible transfer system has excellent sharpness and a high density, and is suitable for the recording of binary images such as characters and line drawings. Furthermore, formation of multicolor images or color images is also enabled by repeatedly performing recording on a transfer-receiving paper using thermal transfer sheets of yellow, magenta, cyan, black, and other colors.

Since various kinds of printing can be conveniently formed using a thermal head or the like in such a thermofusible transfer system, the thermofusible transfer system is also used for printing characters, bar codes, and the like in order to implement management of manufactured products and the like in industrial plants.

CITATION LIST

Patent Literature

Patent Literature 1: JP 57-105395 A

SUMMARY OF INVENTION

Technical Problem

For example, in a case where printing is performed by a thermofusible transfer system using a thermal transfer sheet on a packaging material to be subjected to a boiling sterilization process or the like after packaging of food, or on a plastic film to be used as a packaging material for retort pouch foods, the printed matter thus obtained is required to have boiling resistance such that the printed matter is not deleted despite being stirred in boiling hot water.

The present invention was achieved under such circumstances, and it is an object of the invention to provide a thermal transfer sheet which exhibits satisfactory printability and excellent boiling resistance of printed matter.

Solution to Problem

A thermal transfer sheet of a first aspect of the present invention includes a substrate, a transferable protective layer and a transferable color layer disposed in this order on one side of the substrate, and a back face layer disposed on the other side of the substrate, wherein the transferable protective layer contains a cyclic olefin-based polymer having a glass transition temperature of 100° C. or more as a main component and an incompatible resin with the cyclic olefin-based polymer, and the transferable color layer contains a colorant and a phenolic resin having a softening point of 100° C. or more.

According to the thermal transfer sheet of the first aspect of the present invention, since the phenolic resin having a softening point of 100° C. or more is included as a binder resin of the transferable color layer, and the transferable protective layer contains the cyclic olefin-based polymer having a glass transition temperature of 100° C. or more as a main component and further contains the incompatible resin with the cyclic olefin-based polymer, a thermal transfer sheet exhibiting satisfactory printability and excellent boiling resistance of printed matter can be provided.

Furthermore, a thermal transfer sheet of a second aspect of the present invention includes a substrate, a transferable color layer disposed on one side of the substrate, and a back face layer disposed on the other side of the substrate, wherein the transferable color layer contains a colorant, and a binder resin containing a reaction product between a phenolic resin having a softening point of 100° C. or more and an adduct product of an aliphatic polyisocyanate.

According to the thermal transfer sheet of the second aspect of the present invention, since the transferable color layer contains the reaction product between a phenolic resin having a softening point of 100° C. or more and an adduct product of an aliphatic polyisocyanate as a binder resin, a thermal transfer sheet exhibiting satisfactory printability and excellent boiling resistance of printed matter can be provided.

Furthermore, a thermal transfer sheet of a third aspect of the present invention includes a substrate, a transferable release layer and a transferable color layer disposed on one side of the substrate in this order from the substrate side, and a back face layer disposed on the other side of the substrate, wherein the transferable release layer contains a wax having a melting point of 65° C. or more and a metallic soap, and the transferable color layer contains a colorant and a phenolic resin having a softening point of 100° C. or more.

According to the thermal transfer sheet of the third aspect of the present invention, since the transferable color layer contains the phenolic resin having a softening point of 100° C. or more as a binder resin, and the transferable release layer contains the wax having a melting point of 65° C. or more and the metallic soap, a thermal sheet exhibiting satisfactory printability and excellent boiling resistance of printed matter can be provided.

A thermal transfer sheet of a fourth aspect of the present invention includes a substrate, a transferable release layer and a transferable color layer disposed on one side of a substrate in this order from the substrate side, and aback face layer disposed on the other side of the substrate, wherein the transferable color layer contains the phenolic resin having a softening point of 100° C. or more and the inorganic filler having an average particle diameter of 3 μm or less.

According to the thermal transfer sheet of the fourth aspect of the present invention, since the transferable color layer contains the phenolic resin having a softening point of 100° C. or more as a binder resin, and the transferable color layer further contains the inorganic filler having an average particle diameter of 3 μm or less, a thermal transfer sheet exhibiting satisfactory printability, excellent blocking resistance, and satisfactory boiling resistance of printed matter, can be provided.

Advantageous Effects of Invention

According to the present invention, a thermal transfer sheet which exhibits satisfactory printability and excellent boiling resistance of printed matter can be provided.

DESCRIPTION OF EMBODIMENTS

Figure 1:
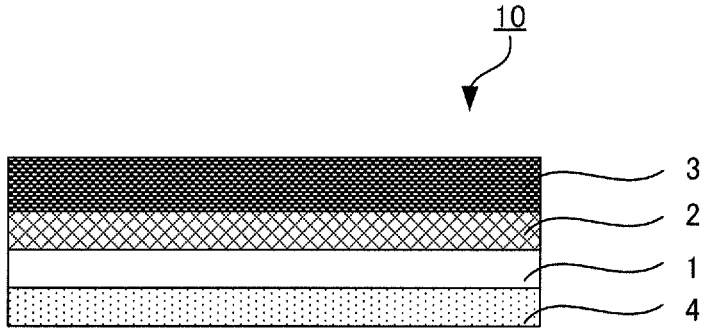
FIG. 1 is a schematic cross-sectional view illustrating an example of a thermal transfer sheet of the present invention.

The thermal transfer sheet according to the present invention includes a first embodiment to a fourth embodiment described below.

[Thermal Transfer Sheet of First Embodiment]

The thermal transfer sheet of the first embodiment of the present invention is a thermal transfer sheet which includes a substrate, at least a transferable protective layer and a transferable color layer disposed in this order on one side of the substrate, and a back face layer disposed on the other side of the substrate, wherein the transferable protective layer contains a cyclic olefin-based polymer having a glass transition temperature of 100° C. or more as a main component, and further contains an incompatible resin with the cyclic olefin-based polymer, and the transferable color layer contains a colorant and a phenolic resin having a softening point of 100° C. or more.

The thermal transfer sheet of the first embodiment of the present invention contains the phenolic resin having a softening point of 100° C. or more as a binder resin for the transferable color layer, and the transferable protective layer contains the cyclic olefin-based polymer having a glass transition temperature of 100° C. or more as a main component and further contains the incompatible resin with the cyclic olefin-based polymer. Therefore, the thermal transfer sheet exerts an effect of exhibiting satisfactory printability and providing printed matter having excellent boiling resistance.

The mechanism by which the thermal transfer sheet of the first embodiment of the present invention exerts the effect described above is not clearly known, but the mechanism is assumed to be as follows. A phenolic resin has satisfactory adhesiveness to plastic films that are used as packaging materials, and enhances printability. Furthermore, when the phenolic resin having a softening point of 100° C. or more is used, even the transfer of very fine character patterns is satisfactorily achieved, and for example, excellent printability is obtained when single-dot character patterns are printed using a thermal head with a resolution of 300 dpi. Furthermore, excellent heat resistance is imparted to the printed matter by selecting the phenolic resin having a softening point of 100° C. or more as the phenolic resin. When printing is performed using the thermal transfer sheet of the present invention, the transferable protective layer containing the cyclic olefin-based polymer having a glass transition temperature of 100° C. or more as a main component is laminated on the transferable color layer and thus transferred thereto, and the transferable protective layer is disposed on the surface of the printed matter. Since this transferable protective layer contains the cyclic olefin-based polymer having a glass transition temperature of 100° C. or more as a main component, and the cyclic olefin-based polymer contains a bulky alicyclic structure with low polarity in the main chain of a repeating unit, the transferable protective layer has excellent heat resistance and water resistance, and has excellent boiling resistance in boiling hot water. Here, if only the cyclic olefin-based polymer is used, the transferable protective layer has insufficient film cuttability and poor printability; however, the transferable protective layer of the present invention contains the cyclic olefin-based polymer as a main component and also contains the incompatible resin with the cyclic olefin-based polymer. Therefore, in the transferable protective layer of the present invention, a sea-island structure having a discontinuous layer (islands) of the incompatible resin in a continuous layer (sea) of the cyclic olefin-based polymer is formed, and thus satisfactory film cuttability is obtained. Also, as the sea-island structure is combined with the phenolic resin having a softening point of 100° C. or more, satisfactory printability is obtained.

Furthermore, it has been found that a printed matter obtained using the thermal transfer sheet of the present invention has high abrasion resistance because the above-described particular transferable protective layer is used. It is supposed that, since the cyclic olefin-based polymer having a glass transition temperature of 100° C. or more used in the transferable protective layer has high film strength, the printed matter has high abrasion resistance.

Furthermore it is supposed that, since the transferable protective layer containing the cyclic olefin-based polymer having a glass transition temperature of 100° C. or more and the transferable color layer containing the phenolic resin having a softening point of 100° C. or more are laminated, the adhesiveness between layers is increased, thereby further increasing boiling resistance and abrasion resistance.

In regard to the thermal transfer sheet of the first embodiment of the present invention, it is preferable that the transferable protective layer contains 5 to 30 parts by mass of the incompatible resin on the basis of 100 parts by mass of the total amount of the cyclic olefin-based polymer and the incompatible resin, from the viewpoint that an excellent balance is achieved between printability and boiling resistance.

In regard to the thermal transfer sheet of the first embodiment of the present invention, it is preferable that the cyclic olefin-based polymer has a constitutional unit derived from a norbornene-based monomer, from the viewpoint that printed matter having excellent boiling resistance is provided.

In regard to the thermal transfer sheet of the first embodiment of the present invention, it is preferable that the transferable color layer contains a reaction product between the phenolic resin having a softening point of 100° C. or more and an adduct product of an aliphatic polyisocyanate, from the viewpoint of enhancing the boiling resistance of printed matter.

In this case, it is more preferable that the equivalent ratio of isocyanate groups of the adduct product of an aliphatic polyisocyanate to hydroxyl groups of the phenolic resin having a softening point of 100° C. or more, (NCO/OH), is 0.05 to 0.5, from the viewpoint of enhancing the boiling resistance of printed matter.

In regard to the thermal transfer sheet of the first embodiment of the present invention, it is preferable that a transferable release layer is further disposed between the substrate and the transferable protective layer, and the transferable release layer contains a wax having a melting point of 65° C. or more and a metallic soap, from the viewpoint of enhancing the boiling resistance of printed matter.

In this case, it is more preferable that the content of the metallic soap is 15% to 40% by mass on the basis of the total solid content included in the transferable release layer, from the viewpoint of having excellent boiling resistance of printed matter and excellent printability.

Furthermore, in this case, it is more preferable that the metallic soap is zinc stearate, from the viewpoint of enhancing the boiling resistance of printed matter.

In regard to the thermal transfer sheet of the first embodiment of the present invention, it is preferable that the transferable color layer contains an inorganic filler having an average particle diameter of 3 μm or less, from the viewpoint of having excellent blocking resistance.

In this case, it is preferable that the transferable color layer has a convex portion derived from the inorganic filler on the surface, from the viewpoint of having excellent blocking resistance.

Furthermore, it is preferable that the inorganic filler is an inorganic filler having a whiteness degree of 50% or more according to JIS-M8016.

Furthermore, it is more preferable that the inorganic filler is a metal sulfate, from the viewpoint of having excellent blocking resistance and excellent boiling resistance of printed matter.

[Thermal Transfer Sheet of Second Embodiment]

The thermal transfer sheet of the second embodiment of the present invention includes a substrate, at least a transferable color layer disposed on one side of the substrate, and a back face layer disposed on the other side of the substrate, wherein the transferable color layer contains a colorant and a binder resin containing a reaction product between a phenolic resin having a softening point of 100° C. or more and an adduct product of an aliphatic polyisocyanate.

According to the thermal transfer sheet of the second embodiment of the present invention, since the reaction product between a phenolic resin having a softening point of 100° C. or more and an adduct product of an aliphatic polyisocyanate is incorporated as a binder resin for the transferable color layer, a thermal transfer sheet which provides printed matter having excellent boiling resistance can be provided.

According to the thermal transfer sheet of the second embodiment of the present invention, the thermal transfer sheet has boiling resistance even in a case where the transferable protective layer of the thermal transfer sheet of the first embodiment is not laminated on the transferable color layer. Furthermore, the thermal transfer sheet of the second embodiment acquires satisfactory printability by containing the reaction product between a phenolic resin having a softening point of 100° C. or more and an adduct product of an aliphatic polyisocyanate.

In regard to the thermal transfer sheet of the second embodiment of the present invention, it is preferable that the equivalent ratio of isocyanate groups of the adduct product of an aliphatic polyisocyanate to hydroxyl groups of the phenolic resin having a softening point of 100° C. or more, (NCO/OH), is 0.05 to 0.5, in view of boiling resistance.

[Thermal Transfer Sheet of Third Embodiment]

The thermal transfer sheet of the third embodiment of the present invention includes, on one side of a substrate, at least a transferable release layer and a transferable color layer disposed in this order from the substrate side, and includes a back face layer disposed on the other side of the substrate, wherein the transferable release layer contains a wax having a melting point of 65° C. or more and a metallic soap, and the transferable color layer contains a colorant and a phenolic resin having a softening point of 100° C. or more.

Since the thermal transfer sheet of the third embodiment of the present invention contains the phenolic resin having a softening point of 100° C. or more as a binder resin for the transferable color layer, and the transferable release layer contains the wax having a melting point of 65° C. or more and the metallic soap, the thermal transfer sheet exerts an effect of having satisfactory printability and excellent boiling resistance of printed matter.

The mechanism by which the thermal transfer sheet of the third embodiment of the present invention exerts the effect described above is not clearly known, but the mechanism is assumed to be as follows. A phenolic resin has satisfactory adhesiveness to plastic films that are used as packaging materials, and enhances printability. Furthermore, when the phenolic resin having a softening point of 100° C. or more is used, even the transfer of very fine character patterns is satisfactorily achieved, and for example, excellent printability is obtained when single-dot character patterns are printed using a thermal head with a resolution of 300 dpi. Furthermore, when the phenolic resin having a softening point of 100° C. or more is selected as the phenolic resin, excellent heat resistance is imparted to the printed matter.

However, when the color layer becomes the outermost layer in printed matter, as the color layer is rubbed at the time of boiling, insufficient boiling resistance is prone to be obtained. In contrast, when printing is performed using the thermal transfer sheet according to the present invention, the transferable release layer peels off from the substrate, and the transferable release layer is laminated on the transferable color layer and thus transferred thereto. Thus, the transferable release layer is provided as the outermost layer of the printed matter. Since the transferable release layer contains the wax having the particular melting point and the metallic soap, in the present invention, the printed matter has excellent boiling resistance. In the case of using only a wax in the transferable release layer, even if the outermost layer of the printed matter becomes a release layer, boiling resistance is insufficient. It is supposed that this is because the wax melts and flows out at the time of boiling. In contrast, when the wax having the particular melting point and the metallic soap are combined, it is believed that the metallic soap has a function of damming the outflow of the wax in the molten transferable release layer at the time of boiling. As a result, it is supposed that outflow of the wax in a high temperature environment is suppressed. Furthermore, since the metallic soap has excellent affinity with waxes and has heat resistance and excellent slipping properties, it is supposed that even if the surface of the printed matter is rubbed at the time of boiling, the printed matter does not easily fall off, and has excellent boiling resistance.

As mentioned above, due the synergistic effect caused by a combination of the transferable color layer containing the phenolic resin having a softening point of 100° C. or more and the transferable release layer containing the wax having a melting point of 65° C. or more and the metallic soap, the thermal transfer sheet according to the present invention exhibits excellent boiling resistance of printed matter and excellent printability.

In regard to the thermal transfer sheet of the third embodiment of the present invention, it is preferable that the content of the metallic soap is 15% to 40% by mass on the basis of the total solid content included in the transferable release layer, from the viewpoint of having excellent boiling resistance of printed matter and excellent printability.

In regard to the thermal transfer sheet of the third embodiment of the present invention, it is preferable that a transferable protective layer is disposed between the transferable release layer and the transferable color layer, and the transferable protective layer contains a cyclic olefin-based polymer having a glass transition temperature of 100° C. or more as a main component and further contains an incompatible resin with the cyclic olefin-based polymer, from the viewpoint of having excellent boiling resistance of printed matter and excellent abrasion resistance.

In regard to the thermal transfer sheet of the third embodiment of the present invention, it is preferable that the metallic soap is zinc stearate, from the viewpoint of having excellent boiling resistance of printed matter.

[Thermal Transfer Sheet of Fourth Embodiment]

The thermal transfer sheet of the fourth embodiment of the present invention includes, on one side of a substrate, at least a transferable release layer and a transferable color layer disposed in this order from the substrate side, and includes a back face layer disposed on the other side of the substrate, wherein the transferable color layer contains a phenolic resin having a softening point of 100° C. or more and an inorganic filler having an average particle diameter of 3 μm or less.

Since the thermal transfer sheet of the fourth embodiment of the present invention contains the phenolic resin having a softening point of 100° C. or more as a binder resin for the transferable color layer, and further contains the inorganic filler having an average particle diameter of 3 μm or less in the transferable color layer, the thermal transfer sheet exerts an effect of having excellent blocking resistance and providing a printed matter with satisfactory boiling resistance.

It can be believed that the thermal transfer sheet of the fourth embodiment of the present invention has excellent blocking resistance because surface irregularities are formed on the surface of the transferable color layer due to the inorganic filler having an average particle diameter of 3 μm or less that is contained in the transferable color layer, and thereby the contact area between the transferable color layer and the back face layer is decreased when the thermal transfer sheet is laminated.

It can be believed that the satisfactory boiling resistance of the thermal transfer sheet according to the present invention is attributable to the synergistic effect of the enhancement of heat resistance of the transferable color layer itself caused by selecting the phenolic resin having a softening point of 100° C. or more as a binder for the transferable color layer, and the thermal transfer sheet having the transferable release layer. When the color layer becomes the outermost layer in printed matter, as the color layer is rubbed at the time of boiling, insufficient boiling resistance is prone to be obtained. However, when printing is performed using the thermal transfer sheet according to the present invention, the transferable release layer peels off from the substrate, and the transferable release layer is laminated on the transferable color layer and thus transferred thereto. Thus, the transferable release layer is disposed as the outermost layer of the printed matter. Therefore, it can be believed that the printed matter has enhanced abrasion resistance at the time of boiling, in addition to the heat resistance of the transferable color layer itself, and thus satisfactory boiling resistance is obtained.

Furthermore, the phenolic resin contained in the transferable color layer has satisfactory adhesiveness to plastic films that are used as packaging materials, and enhances printability. Furthermore, as the phenolic resin having a softening point of 100° C. or more is used, even the transfer of very fine character patterns is satisfactorily achieved, and for example, excellent printability is obtained when single-dot character patterns are printed using a thermal head with a resolution of 300 d In regard to the thermal transfer sheet of the fourth embodiment of the present invention, it is preferable that a transferable protective layer is further disposed between the transferable release layer and the transferable color layer, and the transferable protective layer contains a cyclic olefin-based polymer having a glass transition temperature of 100° C. or more as a main component and further contains an incompatible resin with the cyclic olefin-based polymer, from the viewpoint of enhancing the boiling resistance of printed matter.

In regard to the thermal transfer sheet of the fourth embodiment of the present invention, it is preferable that the transferable color layer has a convex portion derived from the inorganic filler on the surface, from the viewpoint of having excellent blocking resistance.

In regard to the thermal transfer sheet of the fourth embodiment of the present invention, it is preferable that the inorganic filler is an inorganic filler having a whiteness degree of 50% or more according to JIS-M8016, from the viewpoint that color adjustment is easy.

In regard to the thermal transfer sheet of the fourth embodiment of the present invention, it is preferable that the inorganic filler is a metal sulfate, from the viewpoint of having excellent blocking resistance and excellent boiling resistance of printed matter.

In regard to the thermal transfer sheet of the fourth embodiment of the present invention, it is preferable that the transferable color layer further contains a colorant different from the inorganic filler having an average particle diameter of 3 μm or less, from the viewpoint of making color adjustment easier.

FIG. 1 illustrates an example of the thermal transfer sheet of the present invention. The thermal transfer sheet 10 shown in FIG. 1 is configured to have, on one side of a substrate 1, a transferable protective layer 2 and a transferable color layer 3 disposed in this order from the substrate 1 side, and to have a back face layer 4 disposed on the other side of the substrate 1.

Figure 2:
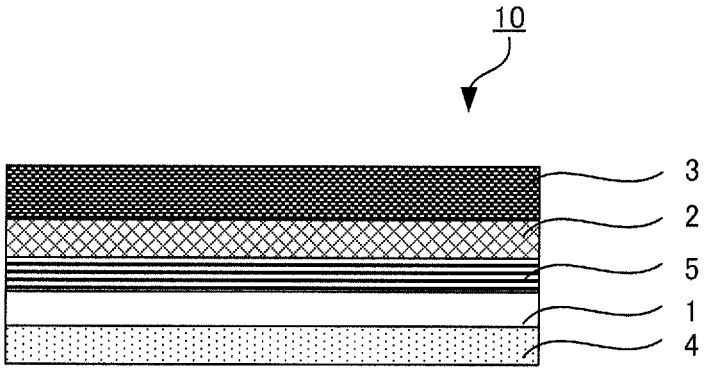
FIG. 2 is a schematic cross-sectional view illustrating a different example of the thermal transfer sheet of the present invention.

FIG. 2 illustrates a different example of the thermal transfer sheet of the present invention. The thermal transfer sheet 10 shown in FIG. 2 is configured have, on one side of a substrate 1, a release layer 5, a transferable protective layer 2, and a transferable color layer 3 disposed in this order from the substrate 1 side, and to have a back face layer 4 disposed on the other side of the substrate 1.

Figure 3:
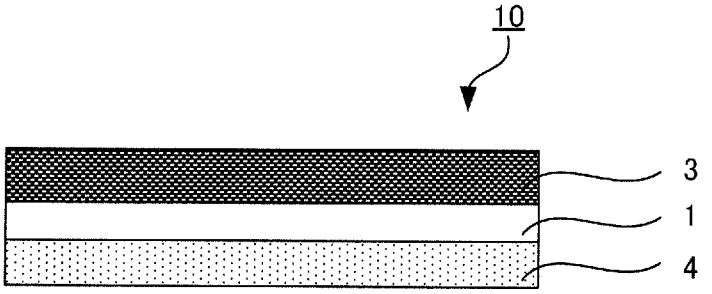
FIG. 3 is a schematic cross-sectional view illustrating a different example of the thermal transfer sheet of the present invention.

FIG. 3 illustrates a different example of the thermal transfer sheet of the present invention. The thermal transfer sheet 10 shown in FIG. 3 is configured to have a transferable color layer 3 disposed on one side of a substrate 1, and a back face layer 4 disposed on the other side of the substrate 1.

Figure 4:
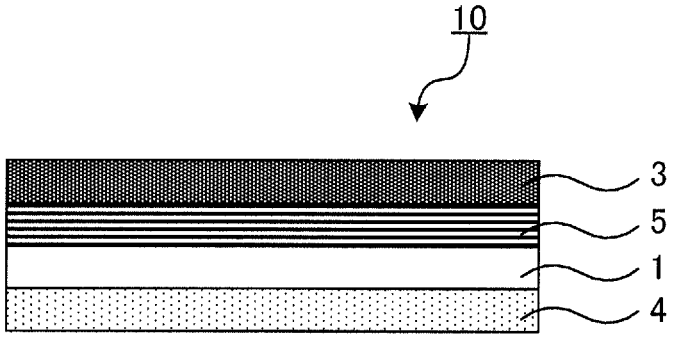
FIG. 4 is a schematic cross-sectional view illustrating a different example of the thermal transfer sheet of the present invention.

FIG. 4 illustrates a different example of the thermal transfer sheet of the present invention. The thermal transfer sheet 10 shown in FIG. 4 is configured to have, on one side of a substrate 1, a release layer 5 and a transferable color layer 3 disposed in this order from the substrate 1 side, and to have a back face layer 4 disposed on the other side of the substrate 1.

Hereinafter, the various layers that constitute the thermal transfer sheet of the present invention will be described in detail.

(Substrate)

Regarding the substrate 1 of the thermal transfer sheet used in the present invention, any conventionally known substrate having a certain degree of heat resistance and a certain degree of strength can be used without any particular limitations.

Specific examples of the substrate include, for example, resin substrates of polyesters such as polyethylene terephthalate, 1,4-polycyclohexylene dimethylene terephthalate, and polyethylene naphthalate; polyphenylene sulfide, a polysulfone, a polycarbonate, a polyamide, a polyimide, cellulose acetate, polyvinylidene chloride, polyvinyl chloride, polyvinyl alcohol, polystyrene, a fluororesin, polypropylene, polyethylene, an ionomer, and the like; and papers such as glassine paper, condenser paper, and paraffin paper; and Cellophane. A composite substrate obtained by laminating two or more kinds thereof can also be used. Furthermore, in the case of a resin substrate, the substrate may be formed of only one kind of the resins described above, or may be formed from two or more kinds of resins.

The thickness of these substrates may appropriately vary depending on the material so as to obtain appropriate strength and heat resistance; however, usually, the thickness is preferably about 0.5 to 50 μm, and more preferably about 1 to 10 μm.

(Transferable Protective Layer)

The thermal transfer sheet of the present invention is provided with, as illustrated in FIG. 1 and FIG. 2, a transferable protective layer 2 between a substrate 1 and a transferable color layer 3, in order to obtain excellent boiling resistance of printed matter. The transferable protective layer is intended to be transferred together with the transferable color layer 3 at the time of thermal transfer and to cover the surface of the transferred image.

The transferable protective layer according to the present invention contains a cyclic olefin-based polymer having a glass transition temperature of 100° C. or more as a main component, and also contains an incompatible resin with the cyclic olefin-based polymer. Here, the main component is intended to mean that the cyclic olefin-based polymer is included at a proportion of more than 50% by mass of the solid content of the transferable protective layer. The content of the cyclic olefin-based polymer is more preferably 70% by mass or more of the solid content of the transferable protective layer, and even more preferably 80% by mass or more of the solid content of the transferable protective layer.

The cyclic olefin-based polymer used in the present invention represents a polymer having a constitutional unit derived from a monomer formed from a cyclic olefin. That is, the cyclic olefin-based polymer has a cyclic structure in the main chain.

Specifically, the cyclic olefin-based polymer used in the present invention may be a cyclic olefin-based polymer or copolymer obtained through ring-opening polymerization of a cyclic olefin, or may be a cyclic olefin-based copolymer obtained through addition polymerization of a cyclic olefin and one or more kinds selected from linear olefins and aromatic compounds having vinyl groups, while a portion thereof or the entirety thereof may be hydrogenated. In regard to the cyclic olefin-based polymer, the cyclic olefin can be used singly, or can be used in combination of two or more kinds thereof.

The type of the copolymerization is not limited in the present invention, and various known copolymerization types such as a random copolymer, a block copolymer, and an alternating copolymer, can be applied.

Among them, the cyclic olefin used for the ring-opening polymerization or addition polymerization is preferably a polycyclic cyclic olefin, and more preferably a norbornene-based monomer having a norbornene ring structure. Examples of the norbornene-based monomer include bicyclic monomers such as bicyclo[2.2.1]hept-2-ene (trivial name: norbornene), 5-ethylidene bicyclo[2.2.1]hept-2-ene (trivial name: ethylidene norbornene), and derivatives thereof (having a substituent on the ring); tricyclic monomers such as tricyclo[$4.3.0^{1,6}.1^{2,5}$]deca-3,7-diene (trivial name: dicyclopentadiene) and derivatives thereof; and tetracyclic monomers such as 7,8-benzotricyclo[$4.3.0.1^{2,5}$]deca-3-ene (trivial name: methanotetrahydrofluorene; also called 1,4-methano-1,4,4a,9a-tetrahydrofluorene) and derivatives thereof, tetracyclo[$4.4.0.1^{2,5}.1^{7,10}$]dodec-3-ene (trivial name: tetracyclododecene), 8-ethylidene tetracyclo[$4.4.0.1^{2,5}.1^{7,10}$]-3-dodecene, and derivatives thereof.

Examples of the substituent that may be possessed by the derivatives include an alkyl group, an alkylene group, a vinyl group, an alkoxycarbonyl group, an alkylidene group, a cyano group, and a halogenated alkyl group. Specific examples of the derivatives include 8-methoxycarbonyl-tetracyclo[$4.4.0.1^{2,5}.1^{7,10}$]dodec-3-ene, 8-methyl-8-methoxycarbonyl-tetracyclo[$4.4.0.1^{2,5}.1^{7,10}$]dodec-3-ene, and 8-ethylidene-tetracyclo[$4.4.0.1^{2,5}.1^{7,10}$]dodec-3-ene.

Examples of the linear olefins used for the addition polymerized type cyclic olefin-based copolymer include α-olefins having 2 to 20 carbon atoms, and examples thereof include ethylene, propylene, 1-butene, 4-methyl-1-pentene, 1-hexene, 1-octene, and 1-decene. Furthermore, specific examples of the aromatic compounds having vinyl groups include styrene, vinylnaphthalene, methylstyrene, propylstyrene, cyclohexylstyrene, dodecylstyrene, 2-ethyl-4-benzylstyrene, 4-(phenylbutyl)styrene, m-divinylbenzene, p-divinylbenzene, and bis(4-vinylphenyl)methane.

The linear olefins and the aromatic compounds having vinyl groups can be used singly, or can be used in combination of two or more kinds thereof.

Regarding the cyclic olefin-based polymer used in the present invention, a cyclic olefin-based polymer having a glass transition temperature (Tg) of 100° C. or more is used from the viewpoint of having excellent boiling resistance. Among them, from the viewpoint of enhancing boiling resistance, the glass transition temperature (Tg) of the cyclic olefin-based polymer is preferably 140° C. or more. It is supposed that this is because, if the glass transition temperature is high, the amount of a repeating unit derived from a cyclic olefin tends to become larger, thereby heat resistance is enhanced, and water absorbency is further decreased.

On the other hand, it is preferable that the glass transition temperature (Tg) of the cyclic olefin-based polymer is 200° C. or less, from the viewpoint of printing sensitivity. It is supposed that this is because, if the glass transition temperature is too high, thermal responsiveness may be impaired.

Incidentally, the glass transition temperature (Tg) according to the present invention is a temperature which can be determined based on the measurement of calorimetric change based on DSC (differential scanning calorimetry) (DSC method).

It is more preferable that the cyclic olefin-based polymer used in the present invention is a cyclic olefin-based polymer having a constitutional unit represented by the following formula (1), from the viewpoints of thermal resistance and flexibility:

[Chemical Formula 1]

(1)

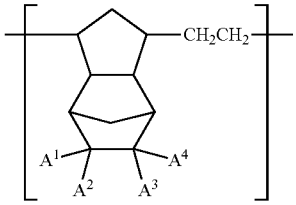

wherein $A^1$, $A^2$, $A^3$, and $A^4$ each independently represent a hydrogen atom, a hydrocarbon group having 1 to 10 carbon atoms, a halogen atom, a hydrocarbon group having 1 to 10 carbon atoms substituted with halogen atom, $—(CH_2)_nCOOR^1$, $—(CH_2)_nOCOR^1$, $—(CH_2)_nOR^1$, $—(CH_2)_nCN$, $—(CH_2)_nCONR^3R^2$, $—(CH_2)_nCOOZ$, $—(CH_2)_nOCOZ$, $—(CH_2)_nOZ$, $—(CH_2)_nW$; —OC—O—CO—, —OC—$NR^4$—CO—, or a (poly)cyclic alkylene group constituted by $A^2$ and $A^3$; or a (poly)cyclic alkylene group. Here, $R^1$, $R^2$, $R^3$ and $R^4$ each represent a hydrocarbon group having 1 to 20 carbon atoms; Z represents a hydrocarbon group substituted with a halogen atom; W represents $SiR^5_pF_{3-p}$ (wherein $R^5$ represents a hydrocarbon group having 1 to 10 carbon atoms; F represents a halogen atom, $—OCOR^6$, or $—OR^6$ (wherein $R^6$ represents a hydrocarbon group having 1 to 10 carbon atoms); and p represents an integer from 0 to 3); and n represents an integer from 0 to 10.

In regard to the cyclic olefin-based polymer having a constitutional unit represented by the following formula (1), among others, a cyclic olefin-based polymer having a substituent which contains oxygen in any one of $A^1$, $A^2$, $A^3$ and $A^4$ is preferred from the viewpoint of interlayer adhesion between the transferable protective layer and the transferable color layer. Examples of the substituent containing oxygen include $—(CH_2)_nCOOR^1$, $—(CH_2)_nOCOR^1$, $—(CH_2)_nOR^1$, $—(CH_2)_nCONR^3R^2$, $—(CH_2)_nCOOZ$, $—(CH_2)_nOCOZ$, $—(CH_2)_nOZ$; —OC—O—CO— and —OC—$NR^4$—CO— constituted by $A^2$ and $A^3$, as described above; however, among them, the substituent containing oxygen is preferably $—(CH_2)_nCOOR^1$ or $—(CH_2)_nOCOR^1$.

The cyclic olefin-based polymer used in the present invention is preferably an amorphous polyolefin resin having amass average molecular weight in the range of 50,000 to 300,000. Incidentally, the mass average molecular weight according to the present invention is a value obtained by gel permeation chromatography (GPC method) and calculated as a value relative to polystyrene standards.

The cyclic olefin-based polymer can be synthesized by subjecting a cyclic olefin to ring-opening polymerization or addition polymerization by a conventionally known method, and then to hydrogenation as necessary. Alternatively, a commercially available product may also be used.

Examples of commercially available products of addition polymerized type cyclic olefin-based polymer include APEL manufactured by Mitsui Chemicals, Inc., and TOPAS manufactured by Polyplastics Co., Ltd. Also, examples of commercially available products of ring-opened type cyclic olefin-based polymer include ZEONEX manufactured by Zeon Corp., and ARTON manufactured by JSR Corp.

On the other hand, the incompatible resin with the cyclic olefin-based polymer, which is used in combination with the cyclic olefin-based polymer, is not particularly limited as long as it is an incompatible resin that does not completely dissolve in the cyclic olefin-based polymer used in combination therewith. Incompatibility is determined according to a standard method in the field of resin industry. For example, a composition obtained by melt mixing 5 parts by mass of a resin on the basis of 100 parts by mass of a cyclic olefin-based polymer, is observed with an electron microscope at a magnification of 100,000 times, and when the composition is found to have at least one domain or particle having an area of 1 $mm^2$ or more in the range of 10 cm×15 cm can be defined to be incompatible.

Regarding the incompatible resin, usually another resin other than a cyclic olefin-based polymer is used. Examples of the other resin that is incompatible with norbornene-based resins include polyethers and polythioethers such as polyphenylene sulfide, polyphenylene ether; polyester-based polymers such as an aromatic polyester, a polyallylate, polyethylene terephthalate, polybutylene terephthalate, a polycarbonate, and a polyether ketone; linear polyolefin-based polymers such as polyethylene, polypropylene, and poly-4-methylpentene-1; general-purpose transparent resins such as polyacrylonitrile-styrene (AS resin); and acrylic resins, and a resin that is incompatible with the cyclic olefin-based polymer used in combination is appropriately selected and used. Among them, a polyol having hydroxyl groups is suitably used, and examples thereof include a polyester polyol, a polycarbonate polyol, a polyether polyol, a polyolefin polyol, and an acrylic polyol.

When a cyclic olefin-based polymer is used as a main component, and an incompatible resin is added thereto, a coating film formed by applying the resins contains a large number of dispersed microdomains or particles of the incompatible resin formed therein. From the viewpoint of enhancing the transparency of the transferable protective layer and the transferability of the transferable protective layer, it is preferable for the microdomains that the average particle diameter [(major axis+minor axis)/2] of the domains observed by electron microscopy is preferably 5 to 30 μm, and more preferably 10 to 20 μm.

From the viewpoint that the boiling resistance and transparency of the transferable protective layer and the transferability of the transferable protective layer can be exhibited in a well-balanced manner, it is preferable that the transferable protective layer contains the incompatible resin in an amount of 5 to 30 parts by mass, and more preferably in an amount of 10 to 25 parts by mass, on the basis of 100 parts by mass of the total amount of the cyclic olefin-based polymer and the incompatible resin.

If the content of the incompatible resin is excessively smaller than the proportion described above, there is a risk that film cuttability at the time of transfer may become poor, and printability may be deteriorated. On the other hand, if the content of the incompatible resin is excessively larger than the proportion, there is a risk that application suitability may be deteriorated, or boiling resistance may be deteriorated.

Furthermore, regarding the transferable protective layer, it is preferable to incorporate, in addition to the thermoplastic resin, a lubricant component such as a metallic soap, a phosphoric acid ester, a polyethylene wax, talc, or silicone resin fine particles, for the purpose of enhancing slipping properties, and various additives such as inorganic or organic fine particles and silicone oils, for the purpose of auxiliary regulation of lubricating properties, and it is particularly preferable that a lubricant component such as a polyethylene wax, talc, or silicone resin fine particles is incorporated.

When the lubricant component described above is included in the transferable protective layer, the content of the lubricant component is preferably 1% to 20% by mass in the solid content of the transferable protective layer.

The coating amount of the transferable protective layer is preferably 0.1 $g/m^2$ to 1.5 $g/m^2$ upon drying, so that film cutting is sufficiently carried out, and a thin layer is formed. Furthermore, in order to achieve film cutting efficiently, the transferable protective layer may be formed by adding a fine extender pigment such as silica, alumina, clay or calcium carbonate.

(Transferable Color Layer)

The transferable color layer 3 contains at least a colorant and a phenolic resin having a softening point of 100° C. or more as a binder resin. When the phenolic resin having a softening point of 100° C. or more is used as the binder resin for the transferable color layer, the transferable color layer exhibits satisfactory printability while having heat resistance.

Examples of the phenolic resin having a softening point of 100° C. or more used in the transferable color layer of the present invention include polyfunctional phenolic resins such as a phenol-novolac resin, a cresol-novolac resin, a bisphenol-novolac resin, a biphenylene-aralkyl resin, a naphthol-aralkyl resin, and a phenol-aralkyl resin (also known as a xylene-modified phenolic resin), and one kind or two or more kinds thereof may also be used in combination. Among them, it is preferable to use a phenol-novolac resin, a cresol-novolac resin, or a bisphenol-novolac resin from the viewpoint of achieving a balance between printability and boiling resistance, and it is more preferable to use a phenol-novolac resin.

Furthermore, the softening point of the phenolic resin is 100° C. or more from the viewpoint of boiling resistance, and is more preferably 110° C. or more.

Incidentally, the softening point of the phenolic resin according to the present invention means the softening point measured according to the method defined in JIS K 7206: 1999.

Examples of a commercially available phenolic resin having a softening point of 100° C. or more include PHENOLITE TD-2091, PHENOLITETD-2090, PHENOLITE VH4170, PHENOLITE KH6021, PHENOLITEKA1163, and PHENOLITE KA1165 (all manufactured by DIC Corp., trade names).

As the binder resin for the transferable color layer, a reaction product between the phenolic resin and a curing agent may be incorporated by using a curing agent in combination with the phenolic resin having a softening point of 100° C. or more. A three-dimensional network structure can be established by crosslinking the phenolic resin using the curing agent, and thereby superior heat resistance can be imparted to the printed matter. Examples of the curing agent include formaldehyde-supplying compounds such as hexamethylenetetramine and para-formaldehyde; and polyisocyanate compounds. Regarding the curing agent that is used in combination with the phenolic resin having a softening point of 100° C. or more in the present invention, among them, a polyisocyanate compound is suitably used.

In regard to the transferable color layer of the present invention, it is preferable to use the phenolic resin and the isocyanate compound in combination such that the equivalent ratio of isocyanate groups of the polyisocyanate compound to hydroxyl groups of the phenolic resin having a softening point of 100° C. or more, (NCO/OH), is 0.05 to 0.5, and more preferably 0.1 to 0.25, from the viewpoint of obtaining satisfactory printability.

Regarding the polyisocyanate compound used as a curing agent for the phenolic resin in the present invention, any compound having two or more isocyanate groups in the molecule can be appropriately used. Examples thereof include aromatic polyisocyanates such as tolylene diisocyanate; alicyclic polyisocyanates such as isophorone diisocyanate; aliphatic polyisocyanates such as hexamethylene diisocyanate; modified polyisocyanates such as adduct products, biuret products, and isocyanurate products of these compounds.

Regarding the polyisocyanate compound used as a curing agent for the phenolic resin in the present invention, among them, it is preferable to use an aliphatic polyisocyanate from the viewpoint of further enhancing boiling resistance. Among them, it is preferable to use an adduct product of an aliphatic polyisocyanate. When a reaction product between a phenolic resin having a softening point of 100° C. or more and an adduct product of an aliphatic polyisocyanate is incorporated as a binder resin for the transferable color layer, satisfactory printability and particularly excellent boiling resistance of printed matter are obtained. It is supposed that this is because, when a curing agent is used with a phenolic resin, a three-dimensional network structure is established, and superior heat resistance is imparted the printed matter; however, in that case, when an aliphatic polyisocyanate is selected and used in combination, flexibility is imparted to the three-dimensional network structure of the phenolic resin so that even in a case where the printed matter on a packaging material has been affected by deformation such as contraction or expansion of the packing material in boiling hot water, the printed matter adheres to the packaging material and is not easily detached.

Regarding the aliphatic polyisocyanate, in addition to hexamethylene diisocyanate, examples include trimethylene diisocyanate, tetramethylene diisocyanate, pentamethylene diisocyanate, and trimethylhexamethylene diisocyanate; however, among them, it is preferable to use hexamethylene diisocyanate from the viewpoint of boiling resistance.

Furthermore, an adduct product refers to a reaction product between a polyisocyanate and a polyol. Regarding the polyol used for the adduct product, an alcohol having two or more hydroxyl groups in the molecule is used, and examples thereof include ethylene glycol, 1,3-propanediol, 1,4-butanediol, 1,6-hexanediol, polyethylene glycol, polypropylene glycol, polytetramethylene glycol, glycerin, trimethylolpropane, trimethylolethane, pentaerythritol, and dimers thereof, polyester polyol, polycarbonate polyol, polyether polyol, and polyolefin polyol. Regarding the polyol used for the adduct product, among them, an alcohol having three or more hydroxyl groups in the molecule is suitably used from the viewpoint of boiling resistance, and among them, glycerin, trimethylolpropane, or trimethylethane is suitably used.

Incidentally, an adduct product can be produced according to a conventionally known method. For example, an adduct product can be produced by allowing the polyisocyanate to react with the polyol by using the polyisocyanate in an amount slightly exceeding the stoichiometric amount.

Examples of a commercially available adduct product of an aliphatic polyisocyanate include DURANATE P301-75E, E402-80B, E405-70B, and AE700-100 (all manufactured by Asahi Kasei Chemicals Corp., trade names).

The mass average molecular weight of the adduct product of an aliphatic polyisocyanate is usually selected in the range of 100 to 100,000, and preferably in the range of 500 to 10,000, from the viewpoint of boiling resistance.

In regard to the transferable color layer of the present invention, it is preferable to use the phenolic resin and the adduct product of an aliphatic polyisocyanate in combination such that the equivalent ratio of isocyanate groups of the adduct product of an aliphatic polyisocyanate to hydroxyl groups of the phenolic resin having a softening point of 100° C. or more, (NCO/OH), would be 0.05 to 0.5, and more preferably 0.1 to 0.3. In this case, it is preferable from the viewpoint that the transferability and printability of the transferable color layer and the boiling resistance of the printed matter are particularly excellent.

Regarding the binder resin in the transferable color layer of the present invention, another binder resin may be further included to the extent that the effects of the present invention are not impaired. Examples of the other binder resin include an acrylic resin, a polyester resin, a polyurethane resin, an ethylene-vinyl acetate copolymer, an ethylene-acrylic acid ester copolymer, polyethylene, polystyrene, polypropylene, polybutene, a petroleum resin, a vinyl chloride resin, a vinyl chloride-vinyl acetate copolymer, polyvinyl alcohol, a vinylidene chloride resin, a methacrylic resin, a polyamide, a polycarbonate, a fluororesin, polyvinyl formal, polyviny butyral, acetyl cellulose, nitrocellulose, polyvinyl acetate, polyisobutylene, ethyl cellulose, and polyacetal.

Regarding the binder resin for the transferable color layer of the present invention, it is preferable that the phenolic resin having a softening point of 100° C. or more (solid content) is included at a proportion of 20% by mass or more, more preferably at a proportion of 30% by mass or more, even more preferably at a proportion of 40% by mass or more, and particularly preferably at a proportion of 50% by mass or more, on the basis of the total solid content of the binder resins, from the viewpoint of boiling resistance. Incidentally, the solid content according to the present invention represents all the components except for the solvent.

Furthermore, in the case of using a curing agent, it is preferable that the total solid content of the reaction product between the phenolic resin having a softening point of 100° C. or more and the curing agent, the phenolic resin having a softening point of 100° C. or more that may be further included in an unreacted form, and the curing agent in an unreacted form, is 70% by mass or more, more preferably 80% by mass or more, even more preferably 90% by mass or more, and particularly preferably 95% by mass or more, on the basis of the total solid content of the binder resin.

From the viewpoint of further enhancing boiling resistance, regarding the binder resin for the transferable color layer of the present invention, an embodiment composed only of a cured product of a resin composition composed of two components, namely, a phenolic resin having a softening point of 100° C. or more and an adduct product of an aliphatic polyisocyanate, is suitably used.

The colorant used for the transferable color layer of the present invention can be appropriately selected for use from carbon black, inorganic pigments, organic pigments, and dyes in accordance with the required color tone. For example, in the case of bar code printing, it is particularly preferable that the print has a sufficient density of black color and does not undergo discoloration or fading caused by light, heat or the like. Examples of such a colorant include carbon black such as lamp black, graphite, and nigrosine dyes. Furthermore, in a case where color printing is demanded, dyes or pigments of other chromatic colors are used. Also, in order to provide satisfactory thermal conductivity and antistatic properties to the extent that the melt viscosity is not markedly increased, a thermally conductive or electrically conductive material such as a carbonaceous material such as carbon black, or a metal powder can be incorporated. Examples of the inorganic metal powder include black powders of manganese oxide, iron oxide, chromium oxide, chromates and the like, which contain metal ions of manganese, cobalt, chromium, iron, copper, lead and the like; blue powders of zirconium, chromium oxide, cobalt oxide, vanadium oxide and the like, which contain metal ions of manganese, cobalt, iron, copper and the like; yellow powders of vanadium, zirconium, chromium, titanium, antimony, copper, silicon and the like, which contain metal ions of titanium, antimony, chromium, zirconium, vanadium, tin and the like; and red powders of aluminum oxide, chromium oxide, iron oxide, cadmium oxide, copper oxide, and the like, which contain metal ions of chromium, selenium, iron, copper, gold, and the like.

It is preferable that the transferable color layer of the present invention contains an inorganic filler having an average particle diameter of 3 μm or less, from the viewpoint of having excellent blocking resistance. It can be believed that excellent blocking resistance is obtained in such a case because surface irregularities are formed on the surface of the transferable color layer due to the inorganic filler having an average particle diameter of 3 μm or less, which is incorporated into the transferable color layer, and therefore, the contact area between the transferable color layer and the back face is decreased when the thermal transfer sheet is laminated.

Incidentally, the inorganic filler is formed from an inorganic compound that does not contain carbon atoms, and compounds that are referred to as inorganic pigments are also included in the inorganic filler. When the colorant that is used in the transferable color layer and is needed for color adjustment corresponds to the inorganic filler having an average particle diameter of 3 μm or less, the colorant may be used as the inorganic filler having an average particle diameter of 3 μm or less. From the viewpoint that color adjustment can be achieved easily, an embodiment of further containing an inorganic filler having an average particle diameter of 3 μm or less in addition to the colorant needed for color adjustment, is suitably used.

The inorganic filler having an average particle diameter of 3 μm or less is not particularly limited, and examples thereof include metal oxides such as calcium oxide, magnesium oxide, zinc oxide, alumina, alumina hydride, silica, colloidal silica, and titanium oxide; metal carbonates such as calcium carbonate, magnesium carbonate, and barium carbonate; metal sulfates such as calcium sulfate, barium sulfate, and magnesium sulfate; metal chlorides such as sodium chloride, magnesium chloride, silver chloride, and calcium chloride; metal silicates such as aluminum silicate and magnesium silicate; alumosilicates, kaolin, talc, wollastonite, and mica.

An inorganic filler having a whiteness degree of 50% or more according to JIS-M8016 is also suitably used from the viewpoint that color can be easily adjusted by using an appropriate colorant in combination therewith. The whiteness degree according to JIS-M8016 is more preferably 80% or more, and even more preferably 90% or more.

Among them, the inorganic filler is preferably a metal carbonate or a metal sulfate from the viewpoint of having excellent boiling resistance, and the inorganic filler is more preferably a metal sulfate from the viewpoint of having excellent affinity with the phenolic resins described above and further enhancing boiling resistance, while barium sulfate is even more preferred.

The average particle diameter of the inorganic filler can be appropriately selected in the range of 3 μm or less, depending on the film thickness of the transferable color layer and the kind of the inorganic filler, so that surface irregularities can be formed on the surface of the transferable color layer. The average particle diameter of the inorganic filler is not particularly limited; however, it is preferable from the viewpoint of printability that the average particle diameter has a value of 1.5 times or less the average film thickness of a region in which a convex portion derived from the inorganic filler is not formed, in the film thickness of the transferable color layer. On the other hand, it is preferable to select the average particle diameter of the inorganic filler to have a value of 1.1 times or more the average film thickness of a region in which a convex portion derived from the inorganic filler is not formed, in the film thickness of the transferable color layer. Incidentally, the average of film thickness of a region in which a convex portion derived from the inorganic filler is not formed can be determined by selecting, for example, 10 sites from the region in which a convex portion derived from the inorganic filler is not formed from the surface of the transferable color layer, and calculating an average value of the film thicknesses measured at each of the sites.

Furthermore, the average particle diameter of the inorganic filler is preferably 1.5 μm or less, from the viewpoint that printability is improved.

On the other hand, the average particle diameter of the inorganic filler is preferably 0.3 μm or more, from the viewpoint that concavo-convex shapes can be easily formed on the surface of the transferable color layer.

Incidentally, the average particle diameter means the 50% particle diameter (d50 median diameter) obtained by analyzing particles in a solution by a dynamic light scattering method, and expressing the particle diameter distribution as a cumulative volume distribution. This average particle diameter can be measured using, for example, a Microtrac particle size analyzer or a Nanotrac particle size analyzer manufactured by Nikkiso Co., Ltd.

The content of the inorganic filler is not particularly limited; however, the content is preferably 5% to 40% by mass, and more preferably 20% to 35% by mass, on the basis of the total solid content included in the transferable color layer. When the content is more than or equal to the lower limit described above, blocking resistance is enhanced, and when the content is less than or equal to the upper limit described above, more satisfactory boiling resistance is obtained.

Furthermore, the transferable color layer may further include other components to the extent that the effects of the present invention are not impaired. For example, the transferable color layer may contain additives such as inorganic fine particles that do not correspond to the colorant and the inorganic filler, organic fine particles, and a mold release agent. Examples of the organic fine particles include a polyethylene wax. Examples of the mold release agent include a silicone oil, a phosphoric acid ester, and a silicone-modified polymer. Furthermore, particularly in a case where a phenolic resin is used in combination with, for example, a curing agent such as a polyisocyanate compound, a curing accelerator such as a zirconium chelate may be incorporated in order to enhance curability and to enhance boiling resistance. The content of the particles having an average particle diameter of more than 3 μm, including pigments and organic fine particles, is preferably 3% by mass or less on the basis of the total solid content included in the transferable color layer, and it is more preferable that the transferable color layer does not contain the particles having an average particle diameter of more than 3 μm.

In regard to the transferable color layer of the present invention, the mixing ratio between the colorant and the binder resin is not particularly limited; however, usually, the colorant is preferably used at a proportion of 20% to 70% by mass, and more preferably at a proportion of 30% to 50% by mass, on the basis of the total solid content of the transferable color layer.

Furthermore, it is preferable that the binder resin is used at a proportion of 30% to 80% by mass, and more preferably at a proportion of 50% to 70% by mass, on the basis of the total solid content of the transferable color layer, from the viewpoints of printability and boiling resistance.

The transferable color layer can be formed by applying a coating liquid obtained by dispersing or dissolving the materials described above in an organic solvent or the like, on a substrate using a conventionally known application means such as gravure printing, die coating printing, bar coating printing, screen printing, roll coating printing, or reverse roll coating printing using a photogravure plate, and drying the coating liquid. Examples of the solvent include ketone-based solvents such as methyl ethyl ketone; aromatic solvents such as toluene; and mixed solvents thereof.

The coating amount of the transferable color layer is not particularly limited; however, the coating amount is usually about 0.6 $g/m^2$ when dried, and preferably 0.4 $g/m^2$ to 3.0 $g/m^2$ when dried. If the coating amount is less than 0.4 $g/m^2$, there is a risk that the transferred print density may be decreased, and if the coating amount is more than 3.0 $g/m^2$, there is a risk that thermal fusibility of the film may decrease, and thermal transfer may not occur easily.

(Back Face Layer)

The thermal transfer sheet of the present invention is provided with a back face layer on the other surface of the substrate, in order to prevent adverse influence such as sticking or print wrinkles due to heat of a thermal head or a heat plate for transfer.

The back face layer can be formed by appropriately selecting a conventionally known thermoplastic resin or the like. Examples of such a thermoplastic resin include thermoplastic resins, including a polyester-based resin, a polyacrylic acid ester-based resin, a polyvinyl acetate-based resin, a styrene-acrylate-based resin, a polyurethane-based resin; a polyolefin-based resin such as a polyethylene-based resin or a polypropylene-based resin; a polystyrene-based resin, a polyvinyl chloride-based resin, a polyether-based resin, a polyamide-based resin, a polyimide-based resin, a polyamideimide-based resin, a polycarbonate-based resin, a polyacrylamide resin, a polyvinyl chloride resin; a polyvinyl acetal-based resin such as a polyvinyl butyral resin or a polyvinyl acetoacetal resin; a polyvinyl alcohol resin; a cellulose-based resin such as an ethyl cellulose resin or a methyl cellulose resin; silicone-modification products thereof; and a fluorine-modified polyurethane-based resin.

Furthermore, a crosslinking agent may also be added to the resin described above. Regarding the polyisocyanate resin that functions as a crosslinking agent, a conventionally known resin can be used without any particular limitations; however, among them, it is preferable to use an adduct product of an aromatic polyisocyanate. Examples of the aromatic polyisocyanate include 2,4-toluene diisocyanate, 2,6-toluene diisocyanate, a mixture of 2,4-toluene diisocyanate and 2,6-toluene diisocyanate, 1,5-naphthalene diisocyanate, toluidine diisocyanate, p-phenylene diisocyanate, trans-cyclohexane-1,4-diisocyanate, xylene diisocyanate, triphenylmethane triisocyanate, and tris(isocyanatophenyl) thiophosphate. Particularly, 2,4-toluene diisocyanate, 2,6-toluene diisocyanate, or a mixture of 2,4-toluene diisocyanate and 2,6-toluene diisocyanate is preferred.

Also, it is preferable that the back face layer contains, in addition to the thermoplastic resin, a lubricant component such as a metallic soap, a phosphoric acid ester, a polyethylene wax, talc, or silicone resin fine particles, for the purpose of enhancing slipping properties; and various additives such as inorganic or organic fine particles and silicone oil, for the purpose of auxiliary regulation of lubricating properties. It is particularly preferable that at least one of a phosphoric acid ester or a metallic soap is incorporated. Also, for an antistatic purpose, conductive carbon may also be incorporated.

The back face layer can be formed by applying, for example, a coating liquid obtained by dispersing or dissolving the thermoplastic resin and various additives that are optionally added, in an appropriate solvent, by a conventionally known method such as gravure coating or gravure reverse coating, and drying the coating liquid.

The coating amount of the back face layer is not particularly limited; however, from the viewpoint of enhancing heat resistance or the like, the coating amount is preferably 0.01 $g/m^2$ to 0.2 $g/m^2$ when dried.

Furthermore, a back face primer layer may be further provided in order to enhance adhesiveness between the back face layer and the substrate, or to further reduce the damage to the substrate sheet caused by the heat of the thermal head.

(Release Layer)

Furthermore, the thermal transfer sheet of the present invention may be provided with a release layer 5 between the substrate 1 and the transferable protective layer 2 as illustrated in FIG. 2, or between the substrate 1 and the transferable color layer 3 as illustrated in FIG. 4, in order to enhance releasability of the layer to be transferred at the time of thermal transfer. The release layer may be a transferable release layer which is transferred together with the transferable color layer 3 and the transferable protective layer 2, or together with the transferable color layer 3, at the time of thermal transfer, or may remain on the substrate side without being transferred. Also, the release layer may undergo cohesive failure, and a portion thereof may be transferred together with the transferable color layer, while the other portion may remain on the substrate side.

The release layer can be formed by applying a coating liquid containing at least one or more kinds selected from waxes such as carnauba wax, paraffin wax, microwax, and silicone wax; a silicone resin, a fluororesin, an acrylic resin, a polyvinyl alcohol resin, a cellulose derivative resin, a urethane-based resin, a vinyl acetate-based resin, an acrylic vinyl ether-based resin, a maleic anhydride resin, a melamine resin, a polyolefin resin, an ionomer resin, a styrene resin, and copolymers of these resins, by a conventionally known method such as gravure coating or gravure reverse coating, and drying the coating liquid. Among them, carnauba wax having strong abrasiveness is preferably used.

Examples of the organic filler that can be added as necessary include an acrylic filler, a polyamide-based filler, a fluorine-based filler, and a polyethylene wax. Also, examples of the inorganic filler that can be added include talc, kaolin, clay, calcium carbonate, magnesium hydroxide, magnesium carbonate, magnesium oxide, and silica.

In regard to the thermal transfer sheet according to the present invention, it is preferable that a transferable release layer is further provided between the substrate and the transferable protective layer, and the transferable release layer contains a wax having a melting point of 65° C. or more and a metallic soap, from the viewpoint that boiling resistance of printed matter is enhanced.

When printing is performed using such a thermal transfer sheet, the layer to be transferred at the time of thermal transfer acquires excellent releasability due to the transferable release layer, and the transferable release layer is disposed as the outermost layer of the printed matter. Since the transferable release layer contains the wax having a particular melting point and the metallic soap, even if the surface of the printed matter is rubbed at the time of boiling, excellent slipping properties are obtained, and boiling resistance of the printed matter is enhanced. In regard to the transferable release layer, the metallic soap has excellent affinity with waxes and heat resistance, and performs a function of damming the outflow of wax in the molten transferable release layer at the time of boiling. Thus, even if the surface of the printed matter is rubbed at the time of boiling, the metallic soap does not easily fall off. As a result, since the outermost layer of the printed matter has excellent slipping properties even at the time of boiling, boiling resistance of the printed matter is enhanced.

Examples of the wax having a melting point of 65° C. or more include microcrystalline wax, carnauba wax, paraffin wax, Fischer-Tropsch wax, a silicone wax, various low molecular weight polyethylenes, wood wax, beeswax, whale wax, insect wax, wool wax, shellac wax, candelilla wax, petrolatum, a partially modified wax, a fatty acid ester, and a fatty acid amide. According to the present invention, among them, carnauba wax having strong abrasiveness is preferably used.

Incidentally, the waxes may be used singly, or two or more kinds thereof may be used in mixture.

The content of the wax having a melting point of 65° C. or more is not particularly limited; however, the content is preferably 60% to 85% by mass, and more preferably 70% to 85% by mass, on the basis of the total solid content included in the transferable release layer. When the content is more than or equal to the lower limit, releasability of the transferable release layer from the substrate is enhanced, and when the content is less than or equal to the upper limit, boiling resistance is enhanced. Incidentally, the solid content according to the present invention means all the components except for the solvent.

Examples of the metallic soap include alkali metal salts, alkaline earth metal salts, and salts of metals such aluminum and zinc of fatty acids, rosin acid, and naphthenic acid, and particularly, an alkaline earth metal salt, an aluminum salt, or a zinc salt of a fatty acid is preferred. Examples of the fatty acid used in the metallic soap include butyric acid, caproic acid, caprylic acid, capric acid, lauric acid, myristic acid, palmitic acid, and stearic acid. Specific examples thereof include, for example, barium stearate, lithium stearate, calcium stearate, zinc stearate, aluminum stearate, and magnesium stearate. Among them, from the viewpoint of boiling resistance, the metallic salt is preferably a magnesium salt, a zinc salt or an aluminum salt, more preferably a zinc salt, and even more preferably zinc stearate. The metal soaps may be used singly, or two or more kinds thereof may be used in mixture.

The average particle diameter of the metal soap is not particularly limited; however, from the viewpoint of printability, the average particle diameter is preferably 0.1 to 2.0 μm, and more preferably 0.5 to 1.5 μm.

Incidentally, the average particle diameter is the 50% particle diameter (d50 median diameter) obtainable when the particle diameter distribution measured by a laser diffraction scattering method is expressed as a cumulative volume distribution. A specific analyzer may be, for example, a laser diffraction/scattering type particle size distribution analyzer manufactured by Horiba, Ltd. Incidentally, the average particle diameter is defined as the average particle diameter of primary particle diameters in a case where the metallic soap is in the form of particles that do not aggregate, and is defined as the average particle diameter of secondary particle diameters in a case where the metallic soap is in the form of aggregated particles.

The melting point of the metallic soap is not particularly limited; however, from the viewpoint of having excellent boiling resistance, the melting point is preferably 90° C. or more, and more preferably 100° C. or more.

The content of the metallic soap is not particularly limited; however, the content is preferably 10% to 40% by mass, more preferably 15% to 30% by mass, and even more preferably 15% to 25% by mass, on the basis of the total solid content included in the transferable release layer. When the content of the metallic soap is more than or equal to the lower limit, the boiling resistance of printed matter is enhanced, and when the content is less than or equal to the upper limit, printability of the thermal transfer sheet, particularly printing sensitivity, is enhanced.

Furthermore, the transferable release layer may contain other materials as necessary, to the extent that the effects of the present invention are not impaired. Examples of the other materials include organic fine particles such as acrylic fine particles, polyamide-based fine particles, fluorine-based fine particles, and a polyethylene wax; inorganic fine particles of talc, kaolin, clay, calcium carbonate, magnesium hydroxide, magnesium carbonate, magnesium oxide, and silica; a silicone resin, a fluororesin, an acrylic resin, a polyvinyl alcohol resin, a cellulose derivative resin, a urethane-based resin, a vinyl acetate-based resin, an acrylic vinyl ether-based resin, a maleic anhydride resin, a melamine resin, a polyolefin resin, an ionomer resin, a styrene resin, and copolymers of these resins.

Incidentally, the transferable release layer may contain a wax having a melting point of less than 65° C.; however, the content of the wax having a melting point of less than 65° C. is preferably 5% by mass or less on the basis of the total solid content included in the transferable release layer, from the viewpoint of boiling resistance.

The transferable release layer can be formed by applying a coating liquid obtained by adding the wax having a melting point of 65° C. or more, the metallic soap, optionally the other materials described above, and a solvent, by a conventionally known application means such as gravure coating, gravure reverse coating, knife coating, air coating, roll coating or die coating, and drying the coating liquid.

Regarding the solvent, any solvent capable of dispersing or dissolving the materials described above can be appropriately selected, and examples thereof include ketone-based solvents such as methyl ethyl ketone; aromatic solvents such as toluene; and mixed solvents thereof.

The coating amount of the release layer is usually about 0.5 g/m$^2$ when dried; however, the coating amount is preferably 0.1 g/m$^2$ to 1.0 g/m$^2$ when dried. If the coating amount is less than 0.1 g/m$^2$, releasability becomes poor, and there is a risk that the effect of the release layer may not be obtained. On the other hand, if the coating amount is more than 1.0 g/m$^2$, transfer may easily occur for each release layer, and there is a risk that transferability of the layer to be transferred may be deteriorated.

The transfer-receiving material that is subjected to printing by the thermal transfer sheet of the present invention may be any of general paper, a bar code label paper, a synthetic paper, a plastic film, a sheet, and formed products of metals, wood, glass, and resins, and there are no particular limitations. However, since the thermal transfer sheet has particularly excellent boiling resistance, the thermal transfer sheet is particularly suitably used for a packaging material that is subjected to a boiling sterilization process or the like after food is packaged therewith, or for a plastic film that is used as a packaging material for retort pouch food. Examples of the packaging material such as described above include various laminate films, and for example, laminate films in which the surface to be printed is formed from a plastic film containing nylon or a polyester resin such as polyethylene terephthalate as a main component, may be mentioned; however, the present invention is not intended to be limited thereto.

Incidentally, the present invention is not intended to be limited to the embodiments described above. The embodiments described above are only for illustrative purposes, and any embodiment which has substantially the same constitution as the technical idea described in the claims of the present invention and provides similar operating effects is included in the technical scope of the present invention.

EXAMPLES

Hereinafter, the present invention will be described in more detail by way of Examples and Comparative Examples. The present invention is not intended to be limited by these descriptions. Furthermore, in the following description, the unit parts or percent (%) is on amass basis unless particularly stated otherwise.

Example I Series Examples According to Thermal Transfer Sheet of First Embodiment Hereinafter, Examples and Comparative Examples according to the thermal transfer sheet of the first embodiment are described in Examples 1 to 13 and Comparative Examples 1 to 6.

However, Examples 2 and 13 also correspond to Examples according to the thermal transfer sheet of the second embodiment, Examples 3 to 7, 12 and 13 also correspond to Examples according to the thermal transfer sheet of the third embodiment, and Examples 11 to 13 also correspond to Examples according to the thermal transfer sheet of the fourth embodiment.

Example 1

Production of Thermal Transfer Sheet 1

A biaxially stretched polyethylene terephthalate film (hereinafter, indicated as PET) (trade name: LUMIRROR, manufactured by Toray Industries, Inc.) having a thickness of 4 μm was used as a substrate, and as a back face layer on one side thereof, a coating liquid for back face layer having a composition as described below was applied by a gravure printing method so as to obtain a coating amount after drying of 0.06 g/m$^2$, and dried. Thus, a back face layer was formed. Next, on the surface opposite to the back face layer of the substrate having the back face layer formed thereon, a coating liquid for release layer having a composition as described below was applied by a gravure printing method so as to obtain a coating amount after drying of 0.2 g/m$^2$, and dried. Thus, a release layer was formed. Subsequently, a coating liquid for transferable protective layer 1 having a composition as described below was applied by a gravure printing method so as to obtain a coating amount after drying of 0.2 g/m$^2$, and dried. Thus, a transferable protective layer was formed. Subsequently, a coating liquid for transferable color layer 1 having a composition as described below was applied on the transferable protective layer by a gravure printing method so as to obtain a coating amount after drying of 0.7 g/m$^2$, and dried. Thus, a thermal transfer sheet 1 of Example 1 was formed.

<Coating Liquid for Back Face Layer>

| | |
|---|---|
| Acrylic-modified silicone (POLYALLOY NSA-X55, manufactured by Natoco Co., Ltd.) | 10 parts by mass |
| Silicone isocyanate (DIAROMER SP901, manufactured by Dainichiseika Color & Chemicals Manufacturing Co., Ltd.) | 2 parts by mass |
| Methyl ethyl ketone | 20 parts by mass |
| Toluene | 20 parts by mass |

<Coating liquid for release layer>

| | |
|---|---|
| Carnauba wax (WE-95, manufactured by Konishi Co., Ltd.) | 90 parts by mass |
| Latex (NIPPOL LX430, manufactured by Zeon Corp.) | 10 parts by mass |
| Water/isopropyl alcohol (mixed at a mass ratio of 1:1) | 100 parts by mass |

<Coating Liquid for Transferable Protective Layer 1>

| | |
|---|---|
| Cyclic olefin-based polymer having a constitutional unit derived from a norbornene-based monomer (ARTON G 7810, manufactured by JSR Corp., glass transition temperature: 165° C.) | 80 parts by mass |
| Incompatible resin with the cyclic olefin-based polymer (acrylic polyol resin) (THERMOLAC SU100A, manufactured by Soken Chemical Engineering Co., Ltd.) | 20 parts by mass |
| Polyethylene wax (Slip agent B, manufactured by Showa Ink Co., Ltd.) | 5 parts by mass |
| Toluene/methyl ethyl ketone (mixed at a mass ratio of 1:1) | 100 parts by mass |

<Coating liquid for transferable color layer 1>

| | |
|---|---|
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |
| Toluene and methyl ethyl ketone (mixed at a mass ratio of 1:1) | 5.31 parts by mass |

Example 2

Production of Thermal Transfer Sheet 2

A thermal transfer sheet 2 of Example 2 was obtained in the same manner as in Example 1, except that a coating liquid for transferable color layer 2 having a composition as described below was used as the coating liquid for transferable color layer for the thermal transfer sheet of Example 1.

<Coating Liquid for Transferable Color Layer 2>

| | |
|---|---|
| Equivalent ratio of isocyanate groups of the adduct product of an aliphatic polyisocyanate to hydroxyl groups of the phenolic resin having a softening point of 100° C. or more (NCO/OH); 0.10 | |
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |
| Adduct product of aliphatic polyisocyanate (solid content: 90%) (DURANATE E402-80B, manufactured by Asahi Kasei Chemicals Corp.) | 0.12 parts by mass |
| Toluene and methyl ethyl ketone (mixed at a mass ratio of 1:1) | 5.31 parts by mass |

Comparative Example 1

Production of Comparative Thermal Transfer Sheet 1

A comparative thermal transfer sheet 1 of Comparative Example 1 was obtained in the same manner as in Example 1, except that a transferable protective layer was not formed in the thermal transfer sheet of Example 1.

Comparative Example 2

Production of Comparative Thermal Transfer Sheet 2

A comparative thermal transfer sheet 2 of Comparative Example 2 was obtained in the same manner as in Example 1, except that a coating liquid for comparative transferable protective layer 2 having a composition as described below was used as the coating liquid for transferable protective layer for the thermal transfer sheet of Example 1.

<Coating Liquid for Comparative Transferable Protective Layer 2>

| | |
|---|---|
| Cyclic olefin-based polymer having a constitutional unit derived from a norbornene-based monomer (ARTON G 7810, manufactured by JSR Corp., glass transition temperature: 165° C.) | 100 parts by mass |
| Polyethylene wax (Slip agent B, manufactured by Showa Ink Co., Ltd.) | 5 parts by mass |
| Toluene/methyl ethyl ketone (mixed at a mass ratio of 1:1) | 100 parts by mass |

Comparative Example 3

Production of Comparative Thermal Transfer Sheet 3

A comparative thermal transfer sheet 3 of Comparative Example 3 was obtained in the same manner as in Example 1, except that a coating liquid for comparative transferable protective layer 3 having a composition as described below was used as the coating liquid for transferable protective layer for the thermal transfer sheet of Example 1.

<Coating liquid for comparative transferable protective layer 3>

| | |
|---|---|
| Acrylic resin (DIANAL BR-87, manufactured by Mitsubishi Rayon Co., Ltd., glass transition temperature: 105° C.) | 100 parts by mass |
| Polyethylene wax (Slip agent B, manufactured by Showa Ink Co., Ltd.) | 5 parts by mass |
| Toluene/methyl ethyl ketone (mixed at mass ratio of 1:1) | 100 parts by mass |

Comparative Example 4

Production of Comparative Thermal Transfer Sheet 4

A comparative thermal transfer sheet 4 of Comparative Example 4 was obtained in the same manner as in Example 1, except that a coating liquid for comparative transferable protective layer 4 having a composition as described below was used as the coating liquid for transferable protective layer for the thermal transfer sheet of Example 1.

<Coating Liquid for Comparative Transferable Protective Layer 4>

| | |
|---|---|
| Acrylic polyol resin (ACRYDIC A-814, manufactured by DIC Corp.) | 85 parts by mass |
| Adduct product of xylene diisocyanate (TAKENATE D-110N, manufactured by Mitsui Chemicals, Inc.) | 15 parts by mass |
| Polyethylene wax (Slip agent B, manufactured by Showa Ink Co., Ltd.) | 5 parts by mass |
| Toluene/methyl ethyl ketone (mixed at a mass ratio of 1:1) | 100 parts by mass |

Comparative Example 5

Production of Comparative Thermal Transfer Sheet 5

A comparative thermal transfer sheet 5 of Comparative Example 5 was obtained in the same manner as in Example 1, except that a coating liquid for comparative transferable color layer having a composition as described below, which contained a phenolic resin having a softening point of less than 100° C., was used as the coating liquid for transferable color layer for the thermal transfer sheet of Example 1.

<Coating Liquid for Comparative Transferable Color Layer>

| | |
|---|---|
| Phenolic resin (solid content: 50%) (BRG558, manufactured by Showa Denko K.K., softening point 93° C. to 98° C.) | 2.40 parts by mass |

-continued

| | |
|---|---|
| Carbon black (solid content: 35%) | 2.29 parts by mass |
| Toluene and methyl ethyl ketone (mixed at a mass ratio of 1:1) | 5.31 parts by mass |

[Evaluation of Thermal Transfer Sheet]

(1) Printability

Each of the thermal transfer sheets obtained in Examples 1 and 2 and Comparative Examples 1 to 5 was superimposed on the nylon surface side of a nylon/low-density polyethylene laminate film (thickness 100 μm, manufactured by Dai Nippon Printing Co., Ltd.), and single-dot character patterns were printed with a thermal head having a resolution of 300 dpi, using a melt transfer type thermal printer (B-SX4T, manufactured by Toshiba TEC Corp.) under the printing conditions of (heat adjust: +0, printer speed: 10 IPS). Furthermore, printability was evaluated according to the following evaluation criteria. Printability of "A" or "B" according to the following evaluation criteria is demanded. The evaluation results are presented in Table 1.

<Evaluation Criteria>

A: Printing is achieved satisfactorily when examined by visual inspection.

B: Collapsed parts or deleted parts occurred in an area of less than 80% (area ratio) of printed matter when examined by visual inspection, but to a level without any practical problem.

C: Collapsed parts or deleted parts occurred in an area of 80% or more (area ratio) of printed matter due to transfer failure, when examined by visual inspection.

(2) Evaluation of Boiling Resistance 1

Each of the printed matters formed using the thermal transfer sheets of Examples 1 and 2 and Comparative Examples 1 to 5 was left to stand for 10 minutes in boiling hot water, and then the surface of the printed matter was rubbed for 10 reciprocations with a paper towel. Thereafter, the printed matter was observed by visual inspection, and boiling resistance was evaluated based on the following evaluation criteria. Boiling resistance of "A" according to the following evaluation criteria is demanded. Evaluation results are presented together in Table 1.

<Evaluation Criteria>

A: There is no change in the printed matter after the evaluation test.

B: Deleted parts and detachment occurred in the printed matter after the evaluation test.

(3) Evaluation of Abrasion Resistance

Each of the printed matters formed using the thermal transfer sheets of Examples 1 and 2 and Comparative Examples 1 to 5 was rubbed on the printed surface with corrugated paper under a load of 500 g, using a friction resistance tester (manufactured by Suga Test Instruments Co., Ltd.), and abrasion resistance was evaluated.

<Evaluation Criteria>

A: There is no change in the printed matter before and after the evaluation test.

B: Deleted parts and detachment occurred in the printed matter after 100 reciprocations.

C: Deleted parts and detachment occurred in the printed matter after 50 reciprocations.

TABLE 1

| | Color layer Binder resin | Protective layer Binder resin | Release layer Carnauba wax | Evaluation results Printability | Boiling resistance 1 | Abrasion resistance |
|---|---|---|---|---|---|---|
| Example 1 | Phenolic resin (118-122° C.) | Cyclic olefin-based polymer (165° C.) + acrylic polyol | WE-95 90 parts | A | A | A |
| Example 2 | Phenolic resin (118-122° C.) + isocyanate | Cyclic olefin-based polymer (165° C.) + acrylic polyol | WE-95 90 parts | A | A | A |
| Comparative Example 1 | Phenolic resin (118-122° C.) | None | WE-95 90 parts | A | B | C |
| Comparative Example 2 | Phenolic resin (118-122° C.) | Cyclic olefin-based polymer (165° C.) | WE-95 90 parts | C | A | A |
| Comparative Example 3 | Phenolic resin (118-122° C.) | Acrylic resin BR-87 | WE-95 90 parts | A | B | B |
| Comparative Example 4 | Phenolic resin (118-122° C.) | Acrylic polyol + Isocyanate | WE-95 90 parts | A | B | B |
| Comparative Example 5 | Phenolic resin (93-98° C.) | Cyclic olefin-based polymer (165° C.) + acrylic polyol | WE-95 90 parts | B | B | A |

Summary of Results of Examples 1 and 2 and Comparative Examples 1 to 5

In regard to the thermal transfer sheets obtained in Examples 1 and 2, the transferable protective layer contained a cyclic olefin-based polymer having a glass transition temperature of 100° C. or more and an incompatible resin with the cyclic olefin-based polymer, and the transferable color layer contained a colorant and a phenolic resin having a softening point of 100° C. or more. Therefore, satisfactory printability and excellent boiling resistance of printed matter were obtained. It was found that the thermal transfer sheets obtained in Examples 1 and 2 also exhibited excellent abrasion resistance. Since Example 2 further contained a reaction product between a phenolic resin having a softening point of 100° C. or more and an adduct product of an aliphatic polyisocyanate in the transferable color layer, Example 2 exhibited particularly high boiling resistance of printed matter.

On the other hand, the thermal transfer sheet obtained in Comparative Example 1 did not have a transferable protective layer formed therein, and therefore, the thermal transfer sheet had satisfactory printability but exhibited poorer boiling resistance and abrasion resistance.

The thermal transfer sheet obtained in Comparative Example 2 did not contained an incompatible resin with the cyclic olefin-based polymer having a glass transition temperature of 100° C. or more in the transferable protective layer, and therefore, the thermal transfer sheet exhibited poor printability.

For the thermal transfer sheet obtained in Comparative Example 3, an acrylic resin having a glass transition temperature of 100° C. or more was used as a binder component for the transferable protective layer, and therefore, the thermal transfer sheet had satisfactory printability but exhibited poor boiling resistance.

For the thermal transfer sheet obtained in Comparative Example 4, a combination of an acrylic polyol and an isocyanate resin was used as a binder component for the transferable protective layer, and therefore, the thermal transfer sheet had satisfactory printability but exhibited poor boiling resistance.

The thermal transfer sheet obtained in Comparative Example 5 contained a phenolic resin having a softening point of below 100° C. as a binder resin for the transferable color layer, and therefore, the thermal transfer sheet exhibited poor boiling resistance. Furthermore, the thermal transfer sheet obtained in Comparative Example 5 exhibited inferior printability compared to the Examples containing a phenolic resin having a softening point of 100° C. or more as a binder resin for the transferable color layer.

Example 3

Production of Thermal Transfer Sheet 3

A thermal transfer sheet 3 of Example 3 was obtained in the same manner as in Example 1, except that a transferable release layer was formed by applying a coating liquid for transferable release layer 3 having a composition as described below by a gravure printing method so as to obtain a coating amount after drying of 0.4 g/m$^2$, and drying the coating liquid, instead of the release layer, for the thermal transfer sheet of Example 1. Incidentally, the average particle diameter of the metallic soap was measured using a laser diffraction/scattering type particle size distribution analyzer, LA-920, manufactured by Horiba, Ltd.

<Coating Liquid for Transferable Release Layer 3>

| | |
|---|---|
| Carnauba wax (WE-95, manufactured by Konishi Co., Ltd., melting point 86° C.) | 75 parts by mass |
| Zinc stearate (HYMICRON F-930, manufactured by Chukyo Yushi Co., Ltd., melting point 120° C., average particle diameter 0.9 μm) | 15 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 4

Production of Thermal Transfer Sheet 4

A thermal transfer sheet 4 of Example 4 was obtained in the same manner as in Example 3, except that a coating liquid for transferable release layer 4 having a composition as described below was used, instead of the coating liquid for transferable release layer 3, for the thermal transfer sheet of Example 3.

<Coating Liquid for Transferable Release Layer 4>

| | |
|---|---|
| Carnauba wax (WE-95, manufactured by Konishi Co., Ltd., melting point 86° C.) | 80 parts by mass |
| Zinc stearate (HYMICRON F-930, manufactured by Chukyo Yushi Co., Ltd., melting point 120° C., average particle diameter 0.9 μm) | 10 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 5

Production of Thermal Transfer Sheet 5

A thermal transfer sheet 5 of Example 5 was obtained in the same manner as in Example 3, except that a coating liquid for transferable release layer 5 having a composition as described below was used, instead of the coating liquid for transferable release layer 3, for the thermal transfer sheet of Example 3.

<Coating Liquid for Transferable Release Layer 5>

| | |
|---|---|
| Carnauba wax (WE-95, manufactured by Konishi Co., Ltd., melting point 86° C.) | 70 parts by mass |
| Zinc stearate (HYMICRON F-930, manufactured by Chukyo Yushi Co., Ltd., melting point 120° C., average particle diameter 0.9 μm) | 20 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 6

Production of Thermal Transfer Sheet 6

A thermal transfer sheet 6 of Example 6 was obtained in the same manner as in Example 3, except that a coating liquid for transferable release layer 6 having a composition as described below was used, instead of the coating liquid for transferable release layer 3, for the thermal transfer sheet of Example 3.

<Coating liquid for transferable release layer 6>

| | |
|---|---|
| Carnauba wax (WE-95, manufactured by Konishi Co., Ltd., melting point 86° C.) | 63 parts by mass |
| Zinc stearate (HYMICRON F-930, manufactured by Chukyo Yushi Co., Ltd., melting point 120° C., average particle diameter 0.9 μm) | 27 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 7

Production of Thermal Transfer Sheet 7

A thermal transfer sheet 7 of Example 7 was obtained in the same manner as in Example 3, except that a coating liquid for transferable release layer 7 having a composition as described below was used, instead of the coating liquid for transferable release layer 3, for the thermal transfer sheet of Example 3.

<Coating Liquid for Transferable Release Layer 7>

| | |
|---|---|
| Carnauba wax (WE-95, manufactured by Konishi Co., Ltd., melting point 86° C.) | 70 parts by mass |
| Zinc stearate (HIDORIN Z-7-30, manufactured by Chukyo Yushi Co., Ltd., melting point 120° C., average particle diameter 5.5 μm) | 20 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 8

Production of Thermal Transfer Sheet 8

A thermal transfer sheet 8 of Example 8 was obtained in the same manner as in Example 3, except that a coating liquid for transferable release layer 8 having a composition as described below was used, instead of the coating liquid for transferable release layer 3, for the thermal transfer sheet of Example 3.

<Coating Liquid for Transferable Release Layer 8>

| | |
|---|---|
| Carnauba wax (WE-95, manufactured by Konishi Co., Ltd., melting point 86° C.) | 63 parts by mass |
| Fatty acid amide (HYMICRON L-271, manufactured by Chukyo Yushi Co., Ltd., melting point 100° C., average particle diameter 0.4 μm) | 27 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 9

Production of Thermal Transfer Sheet 9

A thermal transfer sheet 9 of Example 9 was obtained in the same manner as in Example 3, except that a coating liquid for transferable release layer 9 having a composition as described below was used, instead of the coating liquid for transferable release layer 3, for the thermal transfer sheet of Example 3.

<Coating Liquid for Transferable Release Layer 9>

| | |
|---|---|
| Carnauba wax (WE-95, manufactured by Konishi Co., Ltd., melting point 86° C.) | 63 parts by mass |
| Polyethylene wax (POLYRON L-788, manufactured by Chukyo Yushi Co., Ltd., melting point 102° C., average particle diameter 0.1 μm) | 27 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Example 10

Production of Thermal Transfer Sheet 10

A thermal transfer sheet 10 of Example 10 was obtained in the same manner as in Example 3, except that a coating liquid for transferable release layer 10 having a composition as described below was used, instead of the coating liquid for transferable release layer 3, for the thermal transfer sheet of Example 3.

<Coating Liquid for Transferable Release Layer 10>

| | |
|---|---|
| Carnauba wax (WE-95, manufactured by Konishi Co., Ltd., melting point 86° C.) | 63 parts by mass |
| Paraffin wax (WE-65, manufactured by Konishi Co., Ltd., melting point 75° C.) | 27 parts by mass |
| Latex (NIPPOL LX430, manufactured by Zeon Corp.) | 10 parts by mass |
| Mixed solvent of water and isopropyl alcohol (mixed at a mass ratio of 1:1) | 100 parts by mass |

Comparative Example 6

Production of Comparative Thermal Transfer Sheet 6

A comparative thermal transfer sheet 6 of Comparative Example 6 was obtained in the same manner as in Example 3, except that a coating liquid for comparative transferable color layer having a composition as described below was used, instead of the coating liquid for transferable color layer, for the thermal transfer sheet of Example 3.

<Coating Liquid for Comparative Transferable Color Layer>

| | |
|---|---|
| Acrylic resin (BR-79 manufactured by Mitsubishi Rayon Co., Ltd., Tg 35° C., Mw 70,000) | 1.20 parts by mass |
| Carbon black (solid content 35%) | 2.29 parts by mass |
| Mixed solvent of toluene and methyl ethyl ketone (mixed at a mass ratio of 1:1) | 5.31 parts by mass |

[Evaluation of Thermal Transfer Sheets]

(1) Evaluation of Printability

Printing was performed for an evaluation of printability, in the same manner as in Example 1, using the thermal transfer sheets of Examples 3 to 10 and Comparative Example 6, and printability was evaluated according to the same evaluation criteria as those of Example 1. The evaluation results are presented in Table 2.

(2) Evaluation of Boiling Resistance (Evaluation of Boiling Resistance 1)

Boiling resistance was evaluated in the same manner as in Evaluation of boiling resistance 1 of Example 1, using the various printed matters formed using the thermal transfer sheets of Examples 3 to 10 and Comparative Example 6. The evaluation results are presented in Table 2.

(Evaluation of Boiling Resistance 2)

Each of the printed matters formed using the thermal transfer sheets of Examples 3 to 10 and Comparative Example 6 was left to stand for 30 minutes in boiling hot water, and then the surface of the printed matter was rubbed for 20 reciprocations using a paper towel. Thereafter, the printed matter was observed by visual inspection, and boiling resistance was evaluated based on the following evaluation criteria. The evaluation results are presented in Table 2.

<Evaluation Criteria>

A: There is no change in the printed matter.

B: Deleted parts and detachment occurred in an area of less than 80% (area ratio) of the printed matter, but the printed matter is readable.

C: Deleted parts and detachment occurred in an area of 80% or more (area ratio) of the printed matter, and the printed matter is unreadable.

D: The printed matter has been completely deleted.

(3) Evaluation of Abrasion Resistance

An evaluation of abrasion resistance was carried out in the same manner as in Example 1, using the various printed matters formed using the thermal transfer sheets of Examples 3 to 10 and Comparative Example 6. The evaluation results are presented in Table 2.

TABLE 2

| | | | Release layer | | Evaluation results | | | |
|---|---|---|---|---|---|---|---|---|
| | Color layer Binder resin | Protective layer Binder resin | Carnauba wax | Metallic soap | Printability | Boiling resistance 1 | Boiling resistance 2 | Abrasion resistance |
| Example 3 | Phenolic resin (118-122° C.) | Cyclic olefin-based polymer (165° C.) + acrylic polyol | WE-95 75 parts | Zinc stearate 1 | A | A | A | A |
| Example 4 | Phenolic resin (118-122° C.) | Cyclic olefin-based polymer (165° C.) + acrylic polyol | WE-95 80 parts | Zinc stearate 1 | A | A | B | A |
| Example 5 | Phenolic resin (118-122° C.) | Cyclic olefin-based polymer (165° C.) + acrylic polyol | WE-95 70 parts | Zinc stearate 1 | A | A | A | A |
| Example 6 | Phenolic resin (118-122° C.) | Cyclic olefin-based polymer (165° C.) + acrylic polyol | WE-95 63 parts | Zinc stearate 1 | B | A | A | A |
| Example 7 | Phenolic resin (118-122° C.) | Cyclic olefin-based polymer (165° C.) + acrylic polyol | WE-95 70 parts | Zinc stearate 2 | B | A | A | A |
| Example 8 | Phenolic resin (118-122° C.) | Cyclic olefin-based polymer (165° C.) + acrylic polyol | WE-95 63 parts | Fatty acid amide | B | A | C | A |
| Example 9 | Phenolic resin (118-122° C.) | Cyclic olefin-based polymer (165° C.) + acrylic polyol | WE-95 63 parts | Polyethylene wax | B | A | C | A |

TABLE 2-continued

| | Color layer Binder resin | Protective layer Binder resin | Release layer Carnauba wax | Release layer Metallic soap | Evaluation results Printability | Boiling resistance 1 | Boiling resistance 2 | Abrasion resistance |
|---|---|---|---|---|---|---|---|---|
| Example 10 | Phenolic resin (118-122° C.) | Cyclic olefin-based polymer (165° C.) + acrylic polyol | WE-95 63 parts | Paraffin wax | B | A | C | A |
| Comparative Example 6 | Acrylic resin | Cyclic olefin-based polymer (165° C.) + acrylic polyol | WE-95 75 parts | Zinc stearate 1 | B | B | D | A |

Zinc stearate 1: average particle diameter 0.9 μm
Zinc stearate 2: average particle diameter 5.5 μm

Summary of Results of Examples 3 to 10 and Comparative Example 6

In regard to the thermal transfer sheets obtained in Examples 3 to 7, since the transferable release layers contained a wax having a melting point of 65° C. or more and a metallic soap, the thermal transfer sheets exhibited satisfactory printability and improved boiling resistance of printed matter. In regard to the thermal transfer sheets obtained in Examples 8 to 10, since the transferable release layer did not contain a metallic soap, the thermal transfer sheets exhibited inferior boiling resistance compared to the printed matters of Examples 3 to 7.

In regard to the thermal transfer sheet obtained in Comparative Example 6, since the transferable color layer did not contain a phenolic resin having a softening point of 100° C. or more, the printed matter had poor boiling resistance.

Example 11

Production of Thermal Transfer Sheet 11

A thermal transfer sheet 11 of Example 11 was obtained in the same manner as in Example 1, except that a coating liquid for transferable color layer 11 having a composition as described below was used, instead of the coating liquid for transferable color layer 1, for the thermal transfer sheet of Example 1. A TEM photograph of a vertical cross-section of the thermal transfer sheet 11 was observed, and it was found that the surface of the transferable color layer had a convex portion derived from barium sulfate.

<Coating Liquid for Transferable Color Layer 11>

| | |
|---|---|
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |
| Barium sulfate (average particle diameter 0.7 μm, whiteness degree 93%) | 0.60 parts by mass |
| Mixed solvent of toluene and methyl ethyl ketone (mixed at a mass ratio of 1:1) | 5.31 parts by mass |

Example 12

Production of Thermal Transfer Sheet 12

A thermal transfer sheet 12 of Example 12 was obtained in the same manner as in Example 1, except that the same coating liquid for transferable release layer 3 as that used in Example 3 was used instead of the coating liquid for release layer 1, and the same coating liquid for transferable color layer 11 as that used in Example 11 was used instead of the coating liquid for transferable color layer 1, for the thermal transfer sheet of Example 1. A TEM photograph of a vertical cross-section of the thermal transfer sheet 12 was observed, and it was found that the surface of the transferable color layer had a convex portion derived from barium sulfate.

Example 13

Production of Thermal Transfer Sheet 13

A thermal transfer sheet 13 of Example 13 was obtained in the same manner as in Example 1, except that the same coating liquid for transferable release layer 3 as that used in Example 3 was used instead of the coating liquid for release layer 1, and a coating liquid for transferable color layer 13 having a composition as described below was used instead of the coating liquid for transferable color layer 1, for the thermal transfer sheet of Example 1. A TEM photograph of a vertical cross-section of the thermal transfer sheet 13 was observed, and it was found that the surface of the transferable color layer had a convex portion derived from barium sulfate.

<Coating Liquid for Transferable Color Layer 13>

| | |
|---|---|
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |
| Adduct product of aliphatic polyisocyanate (solid content: 90%) (DURANATE E402-80B, manufactured by Asahi Kasei Chemicals Corp.) | 0.12 parts by mass |
| Barium sulfate (average particle diameter 0.7 μm, whiteness degree 93%) | 0.60 parts by mass |
| Mixed solvent of toluene and methyl ethyl ketone (mixed at a mass ratio of 1:1) | 5.31 parts by mass |

[Evaluation of Thermal Transfer Sheets]

(1) Printability

Printing was performed for an evaluation of printability in the same manner as in Example 1 using the thermal transfer sheets of Examples 11 to 13, and printability was evaluated according to the same evaluation criteria as those of Example 1. The evaluation results are presented in Table 3.

(2) Evaluation of Boiling Resistance

Boiling resistance was evaluated in the same manner as in Evaluation of boiling resistance 1 of Example 1, using the various printed matters formed using the thermal transfer sheets of Examples 11 to 13. The evaluation results are presented together in Table 3.

(3) Blocking Resistance

Regarding each of the thermal transfer sheets obtained in Examples 11 to 13, two sheets each of the sheets were superimposed such that the surface on the transferable color layer side and the surface on the back face layer side faced each other, and the thermal transfer sheets were left to stand for 48 hours at 50° C. at a pressure of 5 kgf/cm$^2$ applied thereon. After the storage, the transferable color layer and the back face layer were detached, and blocking resistance was evaluated based on the ease of detachment. The evaluation results are presented in Table 3.

<Evaluation Criteria>

A: The transferable color layer and the back face layer can be easily detached.

B: Slight sticking is generated between the transferable color layer and the back face layer, but to a level without any practical problem.

C: Sticking is generated between the transferable color layer and the back face layer.

(4) Evaluation of Abrasion Resistance

An evaluation of abrasion resistance was carried out in the same manner as in Example 1, using the various printed matters formed using the thermal transfer sheets of Examples 11 to 13. The evaluation results are presented in Table 3.

TABLE 3

| | Color layer | | | Release layer | | Evaluation results | | | |
|---|---|---|---|---|---|---|---|---|---|
| | Binder resin | Inorganic filler | Protective layer Binder resin | Carnauba wax | Metallic soap | Printability | Boiling resistance 1 | Abrasion resistance | Blocking resistance |
| Example 11 | Phenolic resin (118-122° C.) | Barium sulfate | Cyclic olefin-based polymer (165° C.) + acrylic polyol | WE-95 90 parts | — | A | A | A | A |
| Example 12 | Phenolic resin (118-122° C.) | Barium sulfate | Cyclic olefin-based polymer (165° C.) + acrylic polyol | WE-95 70 parts | Zinc stearate | A | A | A | A |
| Example 13 | Phenolic resin (118-122° C.) + isocyanate | Barium sulfate | Cyclic olefin-based polymer (165° C.) + acrylic polyol | WE-95 70 parts | Zinc stearate | A | A | A | A |

(Summary of Results)

Each of the thermal transfer sheets obtained in Examples 11 to 13 had, on one side of a substrate, a transferable release layer, a transferable protective layer, and a transferable color layer disposed in this order from the substrate side, and the transferable color layer contained a colorant, a phenolic resin having a softening point of 100° C. or more, and an inorganic filler having an average particle diameter of 3 μm or less. Therefore, it was found that the thermal transfer sheets exhibited excellent blocking resistance, and superior boiling resistance, printability and abrasion resistance.

Furthermore, for the various thermal transfer sheets obtained in Example 11, Example 12 and Example 13, an evaluation of boiling resistance was carried out by further extending the time for leaving the thermal transfer sheet in hot water for the evaluation of boiling resistance described above. There was no change in the printed matter for a longer time in the thermal transfer sheet obtained in Example 12 and Example 13, compared to the thermal transfer sheet obtained in Example 11. Therefore, it was found that Example 12 and Example 13 containing a metallic soap in the transferable release layer had superior boiling resistance. When a comparison was made between the thermal transfer sheets obtained in Example 12 and Example 13, Example 13 that further contained a reaction product between a phenolic resin having a softening point of 100° C. or more and an adduct product of an aliphatic polyisocyanate in the color layer, exhibited further increased boiling resistance.

An evaluation of blocking resistance was carried out in the same manner as in Example 11 for the thermal transfer sheets obtained in Examples 1 to 10, in which the transferable color layer did not contain an inorganic filler, and an evaluation result of "B" was obtained, which means that slight sticking is generated between the transferable color layer and the back face layer to a level without any practical problem.

Example II Series Examples According to Thermal Transfer Sheet of Second Embodiment

Example 14

Production of Thermal Transfer Sheet 14

A biaxially stretched polyethylene terephthalate film (hereinafter, indicated as PET) (trade name: LUMIRROR, manufactured by Toray Industries, Inc.) having a thickness of 6 μm was used as a substrate, and as a back face layer on one side thereof, a coating liquid for back face layer having a composition as described below was applied by a gravure printing method so as to obtain a coating amount after drying of 0.1 g/m$^2$, and dried. Thus, a back face layer was formed. Next, on the surface opposite to the back face layer of the substrate having the back face layer formed thereon, a coating liquid for transferable color layer 14 having a composition as described below was applied by a gravure printing method so as to obtain a coating amount after drying of 1.0 g/m$^2$, and dried. Thus, a thermal transfer sheet of Example 14 was formed.

<Coating Liquid for Back Face Layer>

| | |
|---|---|
| Acrylic-modified silicone (POLYALLOY NSA-X55, manufactured by Natoco Co., Ltd.) | 10 parts by mass |
| Silicone isocyanate (DIAROMER SP901, manufactured by Dainichiseika Color & Chemicals Manufacturing Co., Ltd.) | 2 parts by mass |
| Methyl ethyl ketone | 20 parts by mass |
| Toluene | 20 parts by mass |

<Coating Liquid for Transferable Color Layer 14>

| Equivalent ratio of isocyanate groups of the adduct product of an aliphatic polyisocyanate to hydroxyl groups of the phenolic resin having a softening point of 100° C. or more (NCO/OH): 0.10 | |
|---|---|
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |
| Adduct product of aliphatic polyisocyanate (solid content: 80%) (DURANATE E402-80B, manufactured by Asahi Kasei Chemicals Corp.) | 0.12 parts by mass |
| Toluene and methyl ethyl ketone (mixed at a mass ratio of 1:1) | 5.31 parts by mass |

Example 15

Production of Thermal Transfer Sheet 15

A thermal transfer sheet 15 was obtained in the same manner as in Example 14, except that a transferable color layer was formed by changing the coating liquid for transferable color layer 14 to a coating liquid for transferable color layer 15 having a composition as described below, for the production of the thermal transfer sheet 14 of Example 14.

<Coating Liquid for Transferable Color Layer 15>

| Equivalent ratio of isocyanate groups of the adduct product of an aliphatic polyisocyanate to hydroxyl groups of the phenolic resin having a softening point of 100° C. or more (NCO/OH): 0.25 | |
|---|---|
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |
| Adduct product of aliphatic polyisocyanate (solid content: 80%) (DURANATE E402-80B, manufactured by Asahi Kasei Chemicals Corp.) | 0.31 parts by mass |
| Toluene and methyl ethyl ketone (mixed at a mass ratio of 1:1) | 5.31 parts by mass |

Example 16

Production of Thermal Transfer Sheet 16

A thermal transfer sheet 16 was obtained in the same manner as in Example 14, except that a transferable color layer was formed by changing the coating liquid for transferable color layer 14 to a coating liquid for transferable color layer 16 having a composition as described below, for the production of the thermal transfer sheet 14 of Example 14.

<Coating Liquid for Transferable Color Layer 16>

| Equivalent ratio of isocyanate groups of the adduct product of an aliphatic polyisocyanate to hydroxyl groups of the phenolic resin having a softening point of 100° C. or more (NCO/OH): 0.50 | |
|---|---|
| Phenolic resin (solid content: 50%) (phenol-novolac resin, TD-2090, manufactured by DIC Corp., softening point 118° C. to 122° C.) | 2.40 parts by mass |
| Carbon black (solid content: 35%) | 2.29 parts by mass |

-continued

| Equivalent ratio of isocyanate groups of the adduct product of an aliphatic polyisocyanate to hydroxyl groups of the phenolic resin having a softening point of 100° C. or more (NCO/OH): 0.50 | |
|---|---|
| Adduct product of aliphatic polyisocyanate (solid content: 80%) (DURANATE E402-80B, manufactured by Asahi Kasei Chemicals Corp.) | 0.62 parts by mass |
| Toluene and methyl ethyl ketone (mixed at a mass ratio of 1:1) | 5.31 parts by mass |

Example 17

Production of Thermal Transfer Sheet 17

A thermal transfer sheet 17 was obtained in the same manner as in Example 14, except that a transferable color layer was formed by changing the coating liquid for transferable color layer 14 to a coating liquid for transferable color layer 17 having a composition as described below, for the production of the thermal transfer sheet 14 of Example 14.

<Coating Liquid for Transferable Color Layer 17>

| Equivalent ratio of isocyanate groups of the adduct product of an aliphatic polyisocyanate to hydroxyl groups of the phenolic resin having a softening point of 100° C. or more (NCO/OH): 0.10 | |
|---|---|
| Phenolic resin (solid content: 50%) (phenol-novolac resin, TD-2090, manufactured by DIC Corp., softening point 118° C. to 122° C.) | 2.80 parts by mass |
| Carbon black (solid content: 35%) | 1.71 parts by mass |
| Adduct product of aliphatic polyisocyanate (solid content: 80%) (DURANATE E402-80B, manufactured by Asahi Kasei Chemicals Corp.) | 0.14 parts by mass |
| Zirconium chelate (solid content: 20%) | 0.65 parts by mass |
| Toluene and methyl ethyl ketone (mixed at a mass ratio of 1:1) | 5.31 parts by mass |

Example 18

Production of Thermal Transfer Sheet 18

A thermal transfer sheet 18 was obtained in the same manner as in Example 14, except that a transferable color layer was formed by changing the coating liquid for transferable color layer 14 to a coating liquid for transferable color layer 18 having a composition as described below, for the production of the thermal transfer sheet 14 of Example 14.

<Coating Liquid for Transferable Color Layer 18>

| Equivalent ratio of isocyanate groups of the adduct product of an aliphatic polyisocyanate to hydroxyl groups of the phenolic resin having a softening point of 100° C. or more (NCO/OH): 0.10 | |
|---|---|
| Phenolic resin (solid content: 50%) (phenol-novolac resin, TD-2090, manufactured by DIC Corp., softening point 118° C. to 122° C.) | 2.40 parts by mass |

-continued

| | |
|---|---|
| Equivalent ratio of isocyanate groups of the adduct product of an aliphatic polyisocyanate to hydroxyl groups of the phenolic resin having a softening point of 100° C. or more (NCO/OH): 0.10 | |
| Carbon black (solid content: 35%) | 2.29 parts by mass |
| Adduct product of aliphatic polyisocyanate (solid content: 70%) (DURANATE E405-70B, manufactured by Asahi Kasei Chemicals Corp.) | 0.12 parts by mass |
| Toluene and methyl ethyl ketone (mixed at a mass ratio of 1:1) | 5.31 parts by mass |

[Evaluation of Thermal Transfer Sheets]

(1) Printability

Printing was performed for an evaluation of printability in the same manner as in Example 1 using the thermal transfer sheets of Examples 14 to 18, and printability was evaluated according to the same evaluation criteria as those of Example 1. The evaluation results are presented in Table 4.

(2) Evaluation of Boiling Resistance

Boiling resistance was evaluated in the same manner as in Evaluation of boiling resistance 1 of Example 1, using the various printed matters formed using the thermal transfer sheets of Examples 14 to 18. The evaluation results are presented together in Table 4.

TABLE 4

| | Color layer Binder resin | NCO/OH ratio | Printability | Boiling resistance 1 |
|---|---|---|---|---|
| Example 14 | Phenolic resin (118-122° C.) + isocyanate (E402-80B) | 0.10 | A | A |
| Example 15 | Phenolic resin (118-122° C.) + isocyanate (E402-80B) | 0.25 | A | A |
| Example 16 | Phenolic resin (118-122° C.) + isocyanate (E402-80B) | 0.50 | B | A |
| Example 17 | Phenolic resin (118-122° C.) + isocyanate (E402-80B) + zirconium chelate | 0.10 | A | A |
| Example 18 | Phenolic resin (118-122° C.) + isocyanate (E405-70B) | 0.10 | A | A |

(Summary of Results)

In regard to the thermal transfer sheets obtained in Examples 14 to 18, since the transferable color layer contained a reaction product between a phenolic resin having a softening point of 100° C. or more and an adduct product of an aliphatic polyisocyanate as a binder resin, the thermal transfer sheets exhibited satisfactory printability without any practical problem, and excellent boiling resistance of printed matter. Among them, Example 17 containing a zirconium chelate exhibited satisfactory boiling resistance.

Furthermore, an evaluation of blocking resistance was carried out in the same manner as in Example 11 for the thermal transfer sheets obtained in Examples 14 to 18 that did not contain an inorganic filler in the transferable color layers, and an evaluation result of "B" was obtained, in which slight sticking was generated between the transferable color layer and the back face layer, but to a level without any practical problem.

REFERENCE SIGNS LIST

1 substrate
2 transferable protective layer
3 transferable color layer
4 back face layer
5 release layer
10 thermal transfer sheet

The invention claimed is:

1. A thermal transfer sheet comprising:

a substrate;

a transferable protective layer and a transferable color layer disposed in this order on one side of the substrate; and a back face layer disposed on the other side of the substrate, wherein the transferable protective layer contains a cyclic olefin-based polymer having a glass transition temperature of 100° C. or more as a main component and an incompatible resin with the cyclic olefin-based polymer, and the transferable color layer contains a colorant and a phenolic resin having a softening point of 100° C. or more.

2. The thermal transfer sheet according to claim 1, wherein the transferable protective layer contains 5 to 30 parts by mass of the incompatible resin on the basis of 100 parts by mass of the total amount of the cyclic olefin-based polymer and the incompatible resin.

3. The thermal transfer sheet according to claim 1, wherein the cyclic olefin-based polymer has a constitutional unit derived from a norbornene-based monomer.

4. The thermal transfer sheet according to claim 1, wherein the transferable color layer further contains a reaction product between the phenolic resin having a softening point of 100° C. or more and an adduct product of an aliphatic polyisocyanate.

5. The thermal transfer sheet according to claim 4, wherein an equivalent ratio of isocyanate groups of the adduct product of an aliphatic polyisocyanate to hydroxyl groups of the phenolic resin having a softening point of 100° C. or more, (NCO/OH), is 0.05 to 0.5.

6. The thermal transfer sheet according to according to claim 1, wherein a transferable release layer is further disposed between the substrate and the transferable protective layer, and the transferable release layer contains a wax having a melting point of 65° C. or more and a metallic soap.

7. The thermal transfer sheet according to claim 6, wherein the content of the metallic soap is 15% to 40% by mass on the basis of the total solid content of the transferable release layer.

8. The thermal transfer sheet according to claim 6, wherein metallic soap is zinc stearate.

9. The thermal transfer sheet according to claim 1, wherein the transferable color layer contains an inorganic filler having an average particle diameter of 3 μm or less.

10. The thermal transfer sheet according to claim 9, wherein the transferable color layer has a convex portion derived from the inorganic filler on the surface.

11. The thermal transfer sheet according to claim 9 wherein the inorganic filler has a whiteness degree of 50% or more according to JIS -M8016.

12. The thermal transfer sheet according to claim 9, wherein the inorganic filler is a metal sulfate.

* * * * *